US007139514B2

(12) United States Patent
Nakamura et al.

(10) Patent No.: US 7,139,514 B2
(45) Date of Patent: Nov. 21, 2006

(54) DEVELOPING DEVICE, IMAGE FORMING APPARATUS, IMAGE FORMING SYSTEM, AND RESTRICTION MEMBER

(75) Inventors: Masahide Nakamura, Nagano-ken (JP); Nobumasa Abe, Nagano-ken (JP); Ken Ikuma, Nagano-ken (JP); Fuminori Yano, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 10/915,256

(22) Filed: Aug. 10, 2004

(65) Prior Publication Data

US 2005/0069349 A1 Mar. 31, 2005

(30) Foreign Application Priority Data

Aug. 20, 2003 (JP) ..... 2003-296759
Aug. 20, 2003 (JP) ..... 2003-296760

(51) Int. Cl.
*G03G 15/10* (2006.01)

(52) U.S. Cl. ..... 399/239; 399/237

(58) Field of Classification Search ..... 399/233, 399/237, 238, 239
See application file for complete search history.

(56) References Cited

U.S. PATENT DOCUMENTS 4,024,838 A * 5/1977 Horie ..... 399/239
6,101,355 A * 8/2000 Matsumoto et al. ..... 399/239
6,571,075 B1 * 5/2003 Nakashima et al. ..... 399/237
6,868,246 B1 * 3/2005 Takeuchi et al. ..... 399/237

FOREIGN PATENT DOCUMENTS

| | | |
|---|---|---|
| JP | 07-239614 | 9/1995 |
| JP | 08-050415 | 2/1996 |
| JP | 09-185265 | 7/1997 |
| JP | 11-084886 | 3/1999 |
| JP | 2000-187386 | 7/2000 |

* cited by examiner

*Primary Examiner*—Sandra L. Brase
(74) *Attorney, Agent, or Firm*—Hogan & Hartson LLP

(57) ABSTRACT

A developing device includes: a developer bearing body for bearing liquid developer, the liquid developer bore by the developer bearing body being used by the developing device to develop a latent image bore by an image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer.

18 Claims, 15 Drawing Sheets

FIG. 5A
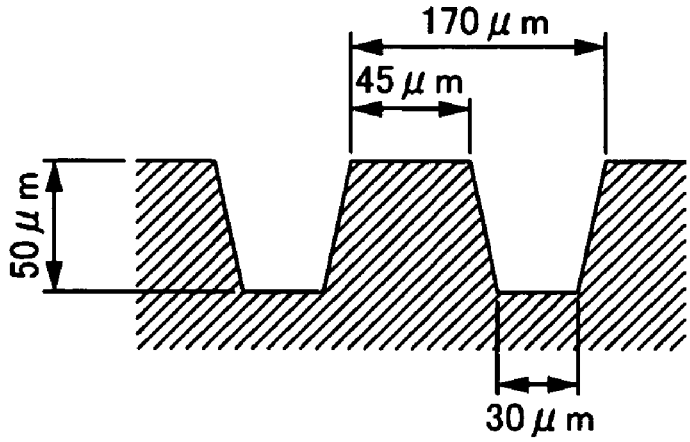
FIG. 5B
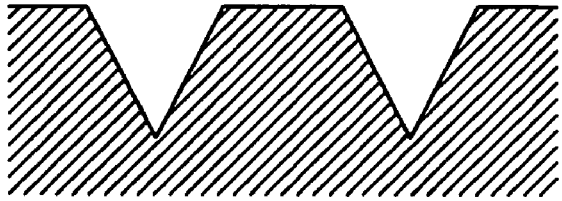
FIG. 5C
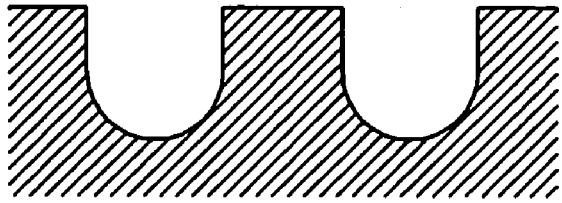
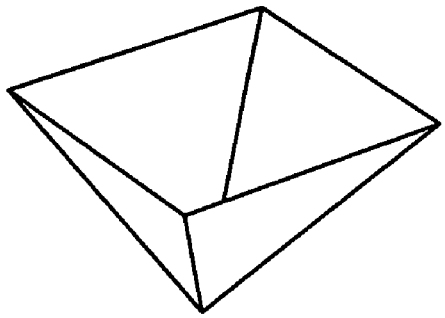
FIG. 5D
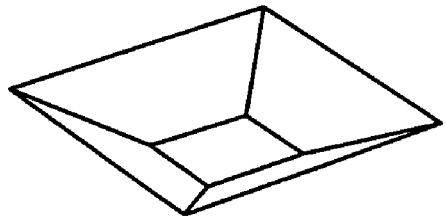
FIG. 5E before transferring during transferring after transferring before transferring during transferring after transferring FIG. 14A
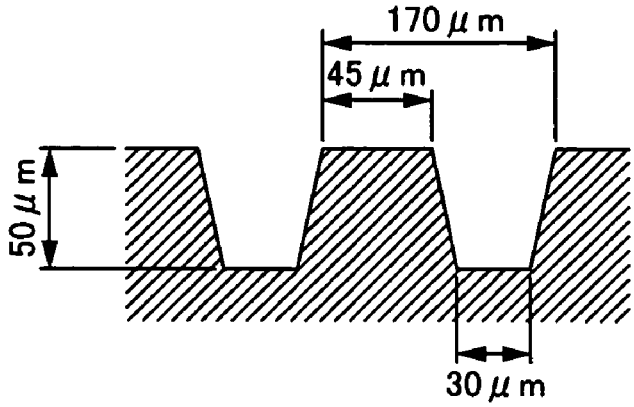
FIG. 14B
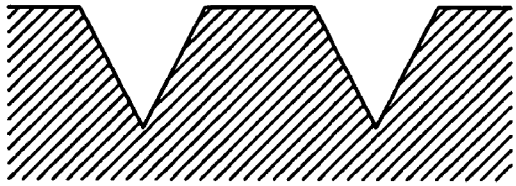
FIG. 14C
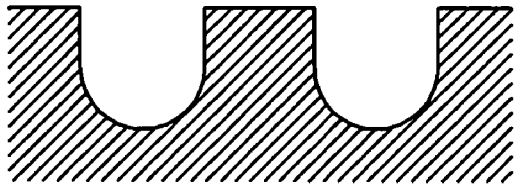
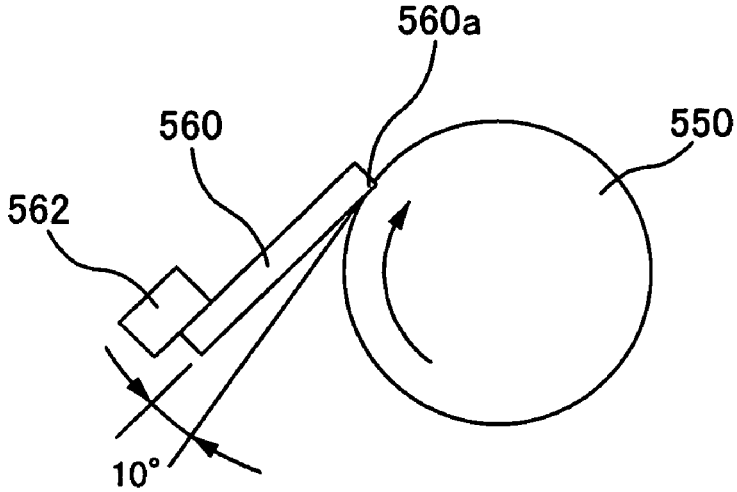
FIG. 15 before transferring during transferring after transferring before transferring during transferring after transferring

DEVELOPING DEVICE, IMAGE FORMING APPARATUS, IMAGE FORMING SYSTEM, AND RESTRICTION MEMBER

CROSS-REFERENCE TO RELATED APPLICATIONS

The present application claims priority upon Japanese Patent Application No. 2003-296759 filed Aug. 20, 2003 and Japanese Patent Application No. 2003-296760 filed Aug. 20, 2003, which are herein incorporated by reference.

BACKGROUND OF THE INVENTION

1. Field of the Invention

The present invention relates to developing devices, image forming apparatuses, image forming systems, and restriction members.

2. Description of the Related Art

There are known image forming apparatuses that include, for example, a photoconductor that serves as an example of an image bearing body for bearing a latent image, and a developing device for developing the latent image bore by the photoconductor with liquid developer (which is also referred to simply as "developer" below). When such a type of image forming apparatus receives image signals etc. from external devices such as host computers, it forms a latent image on the photoconductor. Then, with the rotation of the photoconductor, the latent image formed on and bore by the photoconductor reaches a developing position where it is developed by the developing device, and thus a developer image is formed on the photoconductor.

One type of developing device is provided with a developing roller that serves as an example of a developer bearing body for bearing developer to achieve the above-mentioned function of developing the latent image formed on the photoconductor, a developer supplying roller that serves as an example of a developer supplying member having depressions in its surface and whose surface is pressed in contact with the developing roller for supplying the developer retained in the depressions to the developing roller, and a restriction blade that serves as an example of a restricting section for restricting the amount of developer on the developer supplying roller.

In this type of developing device, the amount of developer on the developer supplying roller is restricted by the restriction blade, and the developer whose amount has been restricted is transferred from the developer supplying roller to the developing roller. The developer transferred to the developing roller is then used for developing the latent image. (See, for example, JP 11-84886A.)

Another type of developing device is provided with a developing roller that has an elastic section and that serves as an example of a developer bearing body for bearing developer to achieve the above-mentioned function of developing the latent image formed on the photoconductor, a developer supplying roller that serves as an example of a developer supplying member having depressions in its surface and whose surface is pressed in contact with the elastic section of the developing roller for supplying the developer retained in the depressions to the developing roller, and a restriction blade that serves as an example of a restriction member for restricting the amount of developer on the developer supplying roller by abutting against the surface of the developer supplying roller.

In this type of developing device, the amount of developer on the developer supplying roller is restricted by the restriction blade, and the developer whose amount has been restricted is transferred from the developer supplying roller to the developing roller. The developer transferred to the developing roller is then used for developing the latent image. (See, for example, JP 9-185265A.)

As described above, the developer whose amount has been restricted by the restriction blade is transferred from the developer supplying roller to the developing roller. There are cases, however, in which rivulets (mottled patterns such as bold streaks) appear in the developer that has been transferred to the developing roller. If the developer that has formed rivulets is used for developing the latent image bore by the photoconductor to form an image, then the image quality will deteriorate.

SUMMARY OF THE INVENTION

The present invention has been made in view of the above and other issues, and an object thereof is to achieve a developing device, an image forming apparatus, an image forming system, and a restriction member that appropriately prevent deterioration of image quality.

An aspect of the present invention is a developing device comprising: a developer bearing body for bearing liquid developer, the liquid developer bore by the developer bearing body being used by the developing device to develop a latent image bore by an image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer.

Another aspect of the present invention is a developing device comprising: a developer bearing body that has an elastic section and that is for bearing liquid developer, the liquid developer bore by the developer bearing body being used by the developing device to develop a latent image bore by an image bearing body; a developer supplying member that has depressions in its surface and whose surface is pressed in contact with the elastic section of the developer bearing body for supplying the liquid developer retained in the depressions to the developer bearing body; and a restriction member for restricting the amount of the liquid developer on the developer supplying member by abutting against the surface of the developer supplying member, the restriction member being an elastic body.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 5A through FIG. 5E show shapes of depressions provided in the surface of the developer supplying roller 550 according to the first embodiment;

FIG. 14A through FIG. 14C show shapes of grooves provided in the surface of the developer supplying roller 550 according to the second embodiment;

FIG. 15 is a schematic diagram showing "trailing restriction" of a restriction blade 560 according to the second embodiment;

DETAILED DESCRIPTION OF THE INVENTION

Figure 1:
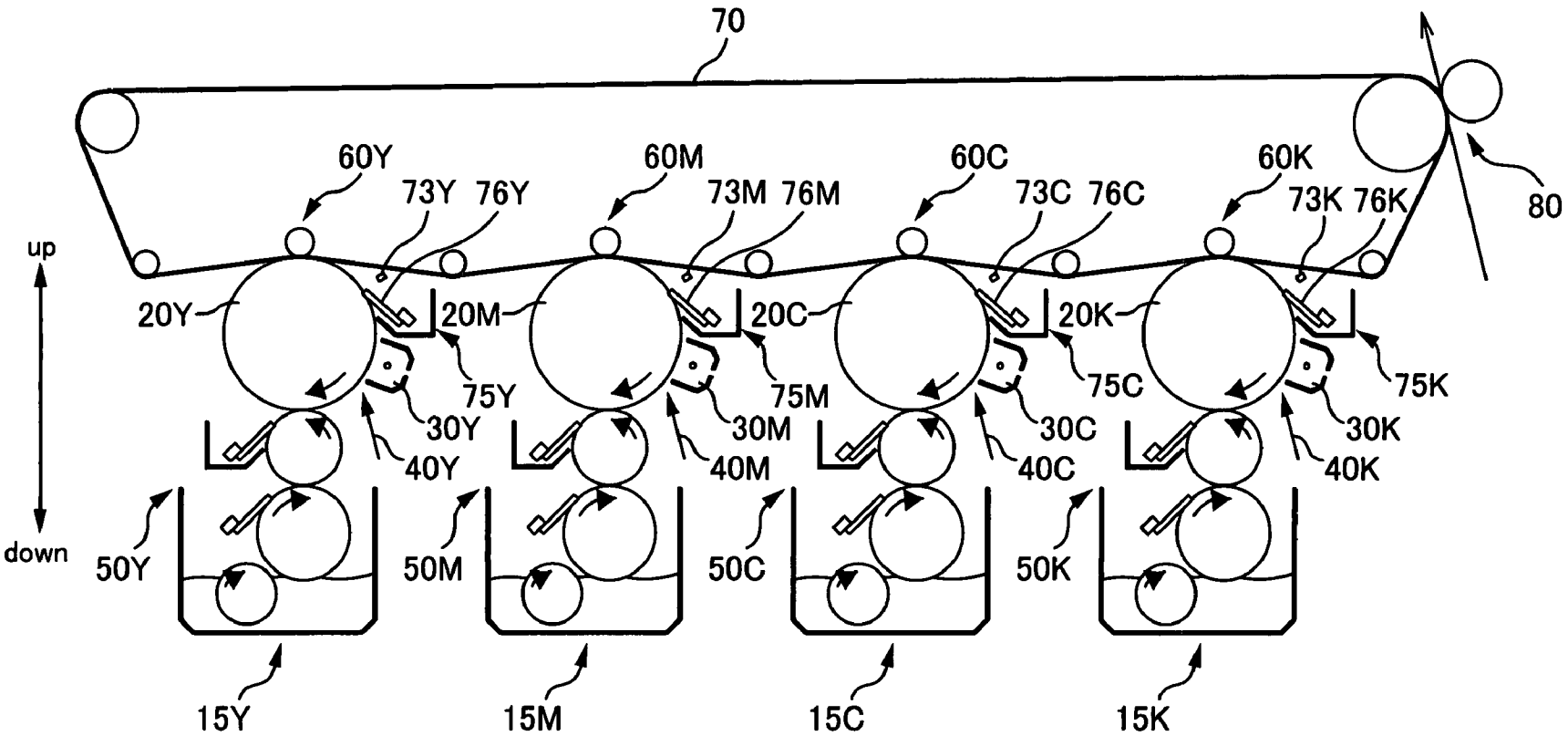
FIG. 1 is a diagram showing main structural components structuring an image forming apparatus according to an embodiment of the present invention.

At least the following matters will be made clear by the explanation in the present specification and the description of the accompanying drawings.

(1) An aspect of the present invention is a developing device comprising: a developer bearing body for bearing liquid developer, the liquid developer bore by the developer bearing body being used by the developing device to develop a latent image bore by an image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer.

It is possible to appropriately prevent deterioration of image quality by making the amount of the liquid developer, which is retained in the depressions and whose amount has been restricted by the restricting section, before being supplied to the developer bearing body smaller than the volumetric capacity of the depressions that retain the liquid developer.

Further, the developer bearing body may be a developing roller, and the developer supplying member may be a developer supplying roller.

Further, the restricting section may be an elastic restriction blade; and the restriction blade may abut against the surface of the developer supplying roller to restrict the amount of the liquid developer on the developer supplying roller.

The structure of the restricting section can be made simple in this way.

Further, the developing roller may have an elastic section; and the surface of the developer supplying roller may be pressed in contact with the elastic section to supply the liquid developer to the developing roller.

In this way, the developer is appropriately transferred from the developer supplying roller to the developing roller.

Further, the hardness of an abutting section of the restriction blade where the restriction blade abuts against the surface of the developer supplying roller may be smaller than the hardness of a press-contact section of the elastic section where the elastic section is pressed in contact with the surface of the developer supplying roller.

In this way, it is possible to make the restriction blade dig into the depressions to an appropriate extent to thereby prevent formation of rivulets, and it is also possible to prevent the elastic section of the developing roller from digging into the depressions too much to thereby curb the disadvantage in that an excessive amount of liquid developer is transferred to the developing roller.

Further, the rotating direction of the developing roller may be opposite from the rotating direction of the developer supplying roller.

In this way, it becomes possible to prevent an excessive rotational resistance from occurring at the press-contact sections of both rollers.

Further, the developer supplying roller may be made of metal.

In this way, it is possible to make the restriction blade and the elastic section of the developing roller dig into the depressions of the developer supplying roller more appropriately.

Further, the restriction blade and the elastic section of the developing roller may both be made of rubber.

Further, the liquid developer may be a non-volatile liquid developer that is non-volatile at room temperature.

In these cases, the above-mentioned effect, that is, the effect of being able to curb the formation of rivulets and prevent deterioration of image quality, is achieved more effectively.

It is also possible to achieve a developing device comprising: a developer bearing body for bearing liquid developer, the liquid developer bore by the developer bearing body being used by the developing device to develop a latent image bore by an image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer, wherein: the developer bearing body is a developing roller, and the developer supplying member is a developer supplying roller; the restricting section is an elastic restriction blade; the restriction blade abuts against the surface of the developer supplying roller to restrict the amount of the liquid developer on the developer supplying roller; the developing roller has an elastic section; the surface of the developer supplying roller is pressed in contact with the elastic section to supply the liquid developer to the developing roller; the hardness of an abutting section of the restriction blade where the restriction blade abuts against the surface of the developer supplying roller is smaller than the hardness of a press-contact section of the elastic section where the elastic section is pressed in contact with the surface of the developer supplying roller; the rotating direction of the developing roller is opposite from the rotating direction of the developer supplying roller; the developer supplying roller is made of metal; the restriction blade and the elastic section of the developing roller are both made of rubber; and the liquid developer is a non-volatile liquid developer that is non-volatile at room temperature.

It is also possible to achieve an image forming apparatus comprising: an image bearing body for bearing a latent image; and a developing device that has: a developer bearing body for bearing liquid developer, the liquid developer bore by the developer bearing body being used by the developing device to develop the latent image bore by the image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer.

With this image forming apparatus, it is possible to appropriately prevent deterioration of image quality.

It is also possible to achieve an image forming system comprising: a computer; and an image forming apparatus that is connectable to the computer and that has: an image bearing body for bearing a latent image; and a developing device that has: a developer bearing body for bearing liquid developer, the liquid developer bore by the developer bearing body being used by the developing device to develop the latent image bore by the image bearing body; a developer supplying member that has depressions in its surface and whose surface is pressed in contact with the developer bearing body for supplying the liquid developer retained in the depressions to the developer bearing body; and a restricting section for restricting the amount of the liquid developer on the developer supplying member, wherein the amount of the liquid developer, which is retained in the depressions and whose amount has been restricted by the restricting section, before being supplied to the developer bearing body is smaller than the volumetric capacity of the depressions that retain the liquid developer.

As an overall system, the image forming system that is achieved in this way becomes superior to conventional systems.

(2) Another aspect of the present invention is a developing device comprising: a developer bearing body that has an elastic section and that is for bearing liquid developer, the liquid developer bore by the developer bearing body being used by the developing device to develop a latent image bore by an image bearing body; a developer supplying member that has depressions in its surface and whose surface is pressed in contact with the elastic section of the developer bearing body for supplying the liquid developer retained in the depressions to the developer bearing body; and a restriction member for restricting the amount of the liquid developer on the developer supplying member by abutting against the surface of the developer supplying member, the restriction member being an elastic body.

It is possible to appropriately prevent deterioration of image quality by making the restriction member be an elastic body.

Further, the developer bearing body may be a developing roller, and the developer supplying member may be a developer supplying roller.

Further, the hardness of an abutting section of the restriction member where the restriction member abuts against the surface of the developer supplying roller may be smaller than the hardness of a press-contact section of the elastic section where the elastic section is pressed in contact with the surface of the developer supplying roller.

In this way, it is possible to make the restriction member dig into the depressions to an appropriate extent to thereby prevent formation of rivulets, and it is also possible to prevent the elastic section of the developing roller from digging into the depressions too much to thereby curb the disadvantage in that an excessive amount of liquid developer is transferred to the developing roller.

Further, the rotating direction of the developing roller may be opposite from the rotating direction of the developer supplying roller.

In this way, it becomes possible to prevent an excessive rotational resistance from occurring at the press-contact sections of both rollers.

Further, the restriction member may abut against the surface of the developer supplying roller at its edge to restrict the amount of the liquid developer on the developer supplying roller.

In this way, it is possible to scrape off the liquid developer on the developer supplying roller more appropriately.

Further, the developer supplying roller may be made of metal.

In this way, it is possible to make the restriction member and the elastic section of the developing roller dig into the depressions of the developer supplying roller more appropriately.

Further, the restriction member and the elastic section of the developing roller may both be made of rubber.

Further, the liquid developer may be a non-volatile liquid developer that is non-volatile at room temperature.

In these cases, the above-mentioned effect, that is, the effect of being able to curb the formation of rivulets and prevent deterioration of image quality, is achieved more effectively.

It is also possible to achieve a developing device comprising: a developer bearing body that has an elastic section and that is for bearing liquid developer, the liquid developer bore by the developer bearing body being used by the developing device to develop a latent image bore by an image bearing body; a developer supplying member that has depressions in its surface and whose surface is pressed in contact with the elastic section of the developer bearing body for supplying the liquid developer retained in the depressions to the developer bearing body; and a restriction member for restricting the amount of the liquid developer on the developer supplying member by abutting against the surface of the developer supplying member, the restriction member being an elastic body, wherein: the developer bearing body is a developing roller, and the developer supplying member is a developer supplying roller; the hardness of an abutting section of the restriction member where the restriction member abuts against the surface of the developer supplying roller is smaller than the hardness of a press-contact section of the elastic section where the elastic section is pressed in contact with the surface of the developer supplying roller; the rotating direction of the developing roller is opposite from the rotating direction of the developer supplying roller; the restriction member abuts against the surface of the developer supplying roller at its edge to restrict the amount of the liquid developer on the developer supplying roller; the developer supplying roller is made of metal; the restriction member and the elastic section of the developing roller are both made of rubber; and the liquid developer is a non-volatile liquid developer that is non-volatile at room temperature.

It is also possible to achieve a restriction member comprising: an elastic body, the restriction member being provided in a developing device that has: a developer bearing body that has an elastic section and that is for bearing liquid developer, the liquid developer bore by the developer bearing body being used by the developing device to develop a latent image bore by an image bearing body; and a developer supplying member that has depressions in its surface and whose surface is pressed in contact with the elastic section of the developer bearing body for supplying the liquid developer retained in the depressions to the developer bearing body, wherein the restriction member restricts the amount of the liquid developer on the developer supplying member by abutting against the surface of the developer supplying member.

With this restriction member, it is possible to appropriately prevent deterioration of image quality.

It is also possible to achieve an image forming apparatus comprising: an image bearing body for bearing a latent image; and a developing device that has: a developer bearing body that has an elastic section and that is for bearing liquid developer, the liquid developer bore by the developer bearing body being used by the developing device to develop the latent image bore by the image bearing body; a developer supplying member that has depressions in its surface and whose surface is pressed in contact with the elastic section of the developer bearing body for supplying the liquid developer retained in the depressions to the developer bearing body; and a restriction member for restricting the amount of the liquid developer on the developer supplying member by abutting against the surface of the developer supplying member, the restriction member being an elastic body.

With this image forming apparatus, it is possible to appropriately prevent deterioration of image quality.

It is also possible to achieve an image forming system comprising: a computer; and an image forming apparatus that is connectable to the computer and that has: an image bearing body for bearing a latent image; and a developing device that has: a developer bearing body that has an elastic section and that is for bearing liquid developer, the liquid developer bore by the developer bearing body being used by the developing device to develop the latent image bore by the image bearing body; a developer supplying member that has depressions in its surface and whose surface is pressed in contact with the elastic section of the developer bearing body for supplying the liquid developer retained in the depressions to the developer bearing body; and a restriction member for restricting the amount of the liquid developer on the developer supplying member by abutting against the surface of the developer supplying member, the restriction member being an elastic body.

As an overall system, the image forming system that is achieved in this way becomes superior to conventional systems.

Overall Configuration Example of Image Forming Apparatus

Next, with reference to FIG. 1, an outline of a laser beam printer 10 (referred to also as "printer 10" below) is described as an example of an image forming apparatus. FIG. 1 is a diagram showing main structural components structuring the printer 10. It should be noted that in FIG. 1, the arrow indicates the vertical direction, and, for example, developing units 50Y, 50M, 50C, and 50K are arranged in the lower section of the printer 10, and an intermediate transferring body 70 is arranged in the upper section of the printer 10.

As shown in FIG. 1, the printer 10 according to the present embodiment includes four developing sections 15Y, 15M, 15C, and 15K, an intermediate transferring body 70, and a second transferring unit 80. The printer 10 further includes a not-shown fusing unit, a displaying unit constructed of a liquid-crystal panel and serving as means for making notifications to users, and a control unit 100 (see FIG. 2) for controlling these units etc. and managing the operations as a printer.

Each of the developing sections 15Y, 15M, 15C, and 15K has the function of developing latent images with yellow (Y) developer, magenta (M) developer, cyan (C) developer, and black (K) developer, respectively. Since the structure of the developing sections 15Y, 15M, 15C, and 15K is substantially the same, only the developing section 15Y is described in detail below.

As shown in FIG. 1, the developing section 15Y includes a charging unit 30Y, an exposing unit 40Y, a developing unit 50Y which serves as an example of a developing device, a first transferring unit 60Y, a static eliminating unit 73Y, and a photoconductor cleaning unit 75Y, all of which being arranged in the direction of rotation of a photoconductor 20Y which serves as an example of an image bearing body.

The photoconductor 20Y has a cylindrical base and a photoconductive layer formed on the outer peripheral surface of the base, and it is rotatable about its central axis. In the present embodiment, the photoconductor 20Y rotates clockwise, as shown by the arrow in FIG. 1.

The charging unit 30Y is a device for charging the photoconductor 20Y. The exposing unit 40Y is a device for forming a latent image on the charged photoconductor 20Y by radiating a laser beam thereon. The exposing unit 40Y has, for example, a semiconductor laser, a polygon mirror, and an F-θ lens, and radiates a modulated laser beam onto the charged photoconductor 20Y according to image signals having been input from a not-shown host computer such as a personal computer or a word processor.

The developing unit 50Y is a device for developing the latent image formed on the photoconductor 20Y using the yellow (Y) developer. Details on the developing unit 50Y will be described further below.

The first transferring unit 60Y is a device for transferring, onto the intermediate transferring body 70, the yellow developer image formed on the photoconductor 20Y. When developer of four colors are successively transferred in a superposed manner by the respective first transferring units 60Y, 60M, 60C, and 60K, a full-color developer image is formed on the intermediate transferring body 70.

The intermediate transferring body 70 is an endless belt that is wound around a plurality of supporting rollers, and is driven to rotate while abutting against the photoconductors 20Y, 20M, 20C, and 20K.

The second transferring unit 80 is a device for transferring the single-color developer image, or the full-color developer image, formed on the intermediate transferring body 70 onto a medium such as paper, film, and cloth.

The fusing unit, which is not shown, is a device for fusing the single-color developer image or the full-color developer image, which has been transferred to the medium, onto the medium such as paper to make it into a permanent image.

The static eliminating unit 73Y is a device for eliminating the electric charge remaining on the photoconductor 20Y after the developer image has been transferred onto the intermediate transferring body 70 by the first transferring unit 60Y.

The photoconductor cleaning unit 75Y is a device that has a photoconductor cleaning blade 76Y made of rubber and made to abut against the surface of the photoconductor 20Y, and that is for removing the developer remaining on the photoconductor 20Y by scraping it off with the photoconductor cleaning blade 76Y after the developer image has been transferred onto the intermediate transferring body 70 by the first transferring unit 60Y.

Figure 2:
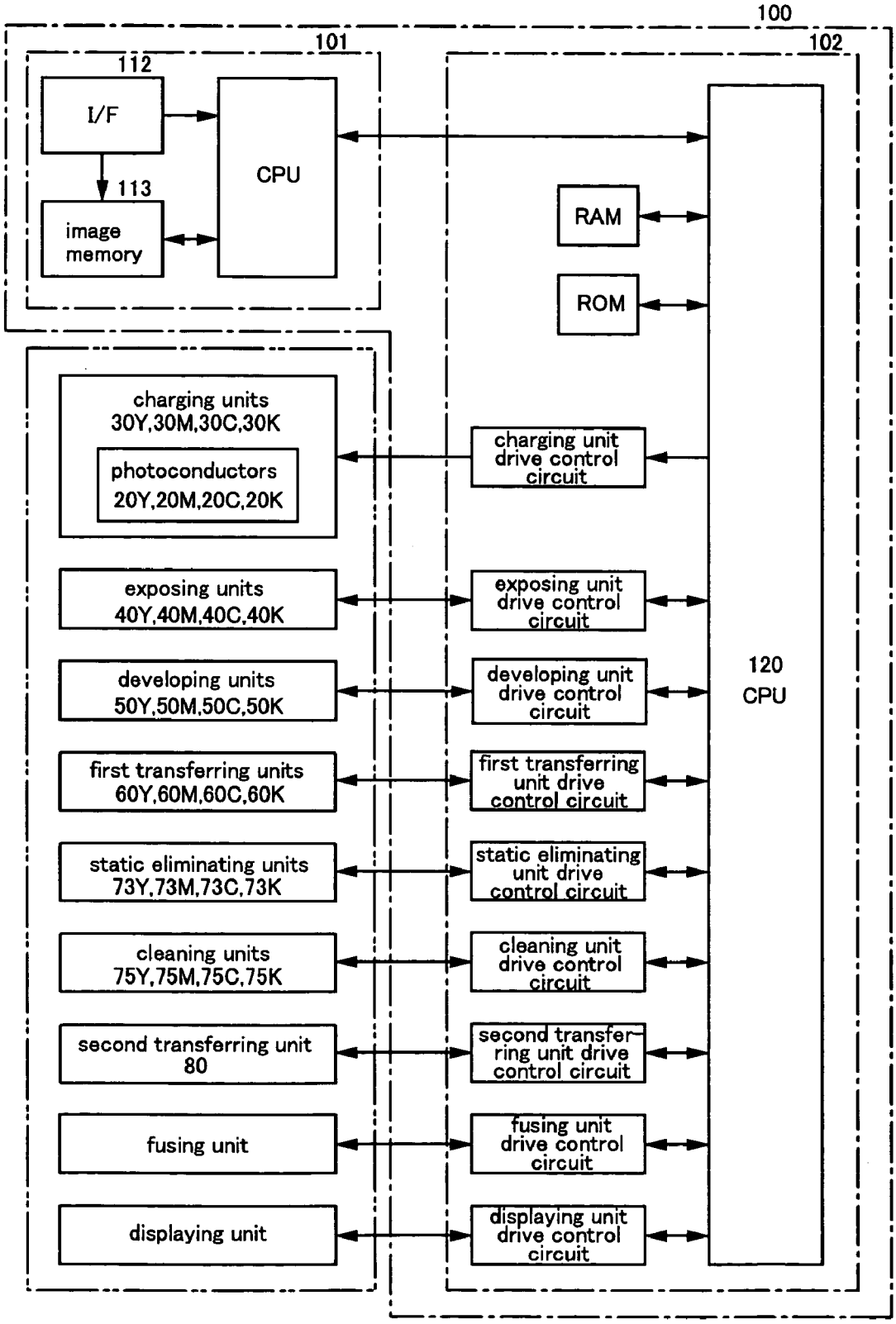
FIG. 2 is a block diagram showing a control unit of the image forming apparatus of FIG. 1.

The control unit 100 includes a main controller 101 and a unit controller 102 as shown in FIG. 2. Image signals and control signals are input to the main controller 101, and according to instructions based on these image signals and control signals, the unit controller 102 controls each of the above-mentioned units etc. to form an image.

Next, operations of the printer 10, which is structured as above, is described below giving consideration to other structural components as well.

When image signals and control signals are input from the not-shown host computer to the main controller 101 of the printer 10 through the interface (I/F) 112, then the photoconductors 20Y, 20M, 20C, and 20K, the developing rollers (described further below) provided in the respective developing units 50Y, 50M, 50C, and 50K, and the intermediate transferring body 70 rotate under the control of the unit controller 102 according to the instructions from the main controller 101. While being rotated, the photoconductors 20Y, 20M, 20C, and 20K are successively charged, respectively, by the charging units 30Y, 30M, 30C, and 30K at respective charging positions.

With the rotation of the photoconductors 20Y, 20M, 20C, and 20K, the charged area of each of the photoconductors 20Y, 20M, 20C, and 20K reaches an exposing position. A latent image that corresponds to the image information for yellow Y, magenta M, cyan C, and black K is formed, respectively, in the charged area of the respective photoconductors by the respective exposing units 40Y, 40M, 40C, and 40K.

With the rotation of the photoconductors 20Y, 20M, 20C, and 20K, the latent image formed on the respective photoconductors 20Y, 20M, 20C, and 20K reaches the developing position, and is developed, respectively, by the respective developing units 50Y, 50M, 50C, and 50K. Thus, a developer image is formed on each of the photoconductors 20Y, 20M, 20C, and 20K.

With the rotation of the photoconductors 20Y, 20M, 20C, and 20K, the developer images formed on the respective photoconductors 20Y, 20M, 20C, and 20K reach their respective first transferring positions, and are transferred onto the intermediate transferring body 70 by the respective first transferring units 60Y, 60M, 60C, and 60K. At this time, a first transferring voltage, which is in an opposite polarity to the polarity to which the developer is charged, is applied to the first transferring units 60Y, 60M, 60C, and 60K. As a result, the developer images in four colors formed respectively on each photoconductor 20Y, 20M, 20C, and 20K are transferred onto the intermediate transferring body 70 in a superposed manner, thereby forming a full-color developer image on the intermediate transferring body 70.

With the rotation of the intermediate transferring body 70, the full-color developer image formed on the intermediate transferring body 70 reaches a second transferring position, and is transferred onto a medium by the second transferring unit 80. It should be noted that the medium is carried from a paper supply tray, which is not shown in the figure, to the second transferring unit 80 by means of various rollers. (The arrow in FIG. 1 indicates the direction in which the medium is carried.) During transferring operations, a second transferring voltage is applied to the second transferring unit 80 and also the unit 80 is pressed against the intermediate transferring body 70.

The full-color developer image transferred onto the medium is heated and pressurized by the fusing unit and fused to the medium.

On the other hand, after the photoconductors 20Y, 20M, 20C, and 20K have passed their respective first transferring positions, the electric charge is eliminated by the respective static eliminating units 73Y, 73M, 73C, and 73K, and the developer adhering to the surface of each photoconductor 20Y, 20M, 20C, and 20K is scraped off by the respective photoconductor cleaning blades 76Y, 76M, 76C, and 76K that are supported on the respective photoconductor cleaning units 75Y, 75M, 75C, and 75K. In this way, the photoconductor 20 is prepared for charging for the next latent image to be formed. The scraped-off developer is collected in a remaining-developer collector of the respective photoconductor cleaning units 75Y, 75M, 75C, and 75K.

Overview of Control Unit

Next, with reference to FIG. 2, the configuration of the control unit 100 is described. The main controller 101 of the control unit 100 is connected to a host computer via an interface 112, and has an image memory 113 for storing image signals that have been input from the host computer. The unit controller 102 is electrically connected to each of the units in the main apparatus body (that is, to the charging units 30Y, 30M, 30C, and 30K, the exposing units 40Y, 40M, 40C, and 40K, the developing units 50Y, 50M, 50C, and 50K, the first transferring units 60Y, 60M, 60C, and 60K, the static eliminating units 73Y, 73M, 73C, and 73K, the photoconductor cleaning units 75Y, 75M, 75C, and 75K, the second transferring unit 80, the fusing unit, and the displaying unit). The unit controller 102 controls each of these units according to signals received from the main controller 101 while detecting the state of each of these units by receiving signals from sensors provided in each unit.

First Embodiment of the Developing Unit etc.

Configuration Example of Developing Unit

Figure 3:
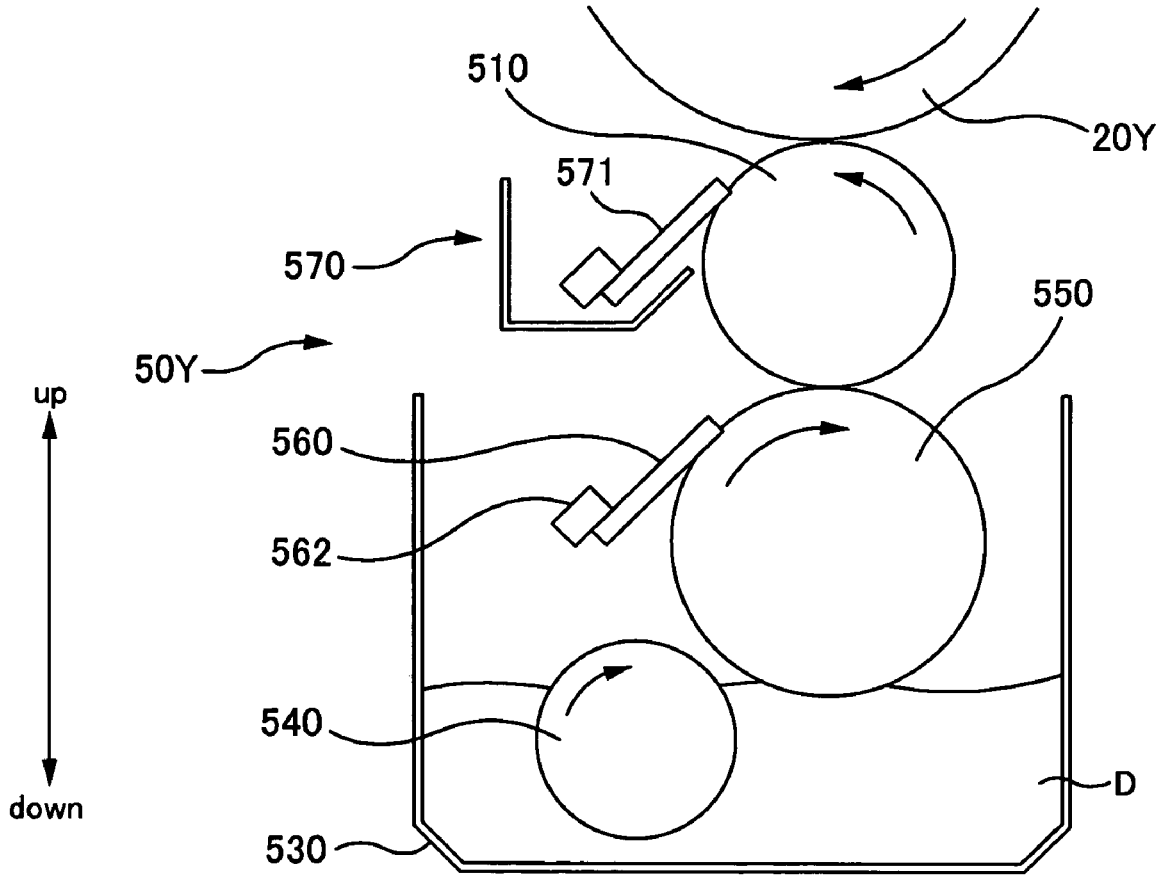
FIG. 3 is a section view showing main structural components of a developing unit according to a first embodiment.
Figure 4:
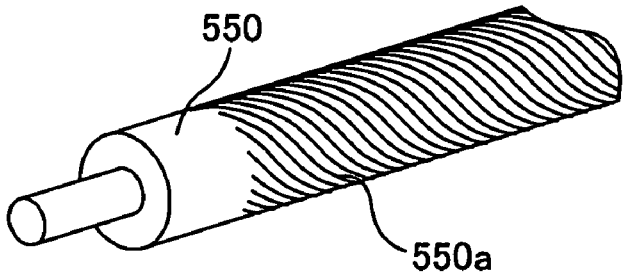
FIG. 4 is a perspective view conceptually showing the surface of a developer supplying roller 550 according to the first embodiment.
Figure 6:
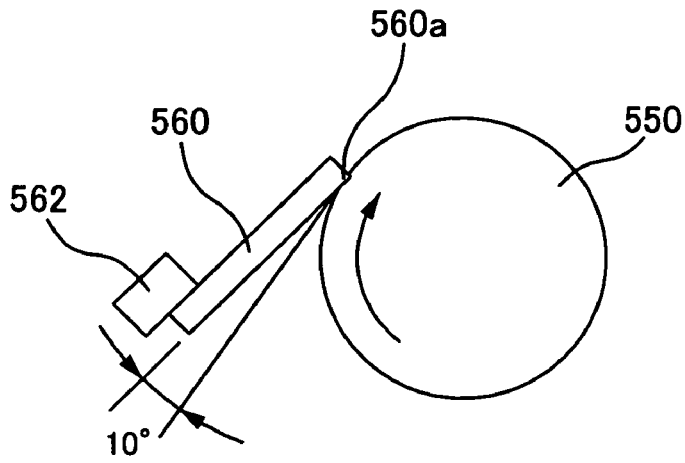
FIG. 6 is a schematic diagram showing "trailing restriction" of a restriction blade 560 according to the first embodiment.

Next, with reference to FIG. 3 through FIG. 9, an example of a configuration of a developing unit according to the first embodiment is described below. FIG. 3 is a section view showing main structural components of a developing unit. FIG. 4 is a perspective view conceptually showing the surface of a developer supplying roller 550. FIG. 5A through FIG. 5E show the shapes of depressions provided in the surface of the developer supplying roller 550. FIG. 6 is a schematic diagram showing "trailing restriction" of a restriction blade 560. FIG. 7, FIG. 8A, FIG. 8B, FIG. 8C, FIG. 9A, FIG. 9B, and FIG. 9C are described further below. It should be noted that in FIG. 3, the arrow indicates the vertical direction as in FIG. 1, and, for example, the developing roller 510 is positioned above the developer drawing roller 540.

The printer 10 has, as developing units, a black developing unit 50K containing black (K) developer, a magenta developing unit 50M containing magenta (M) developer, a cyan developing unit 50C containing cyan (C) developer, and a yellow developing unit 50Y containing yellow (Y) developer. Since the structure of each developing unit is substantially the same, only the yellow developing unit 50Y is described in detail below.

The yellow developing unit 50Y has a developing roller 510 serving as an example of a developer bearing body, a developer containing section 530, a developer drawing roller 540, a developer supplying roller 550 serving as an example of a developer supplying member, a restriction blade 560 serving as an example of a restricting section, and a developing-roller cleaning unit 570.

The developer containing section 530 contains developer D which is for developing a latent image formed on the photoconductor 20Y. The type of developer D contained in the developer containing section 530 is a high-concentration, high-viscosity, non-volatile liquid developer D that is non-volatile at room temperature, and is not the general, conventional volatile liquid developer which employs Isopar (trademark: Exxon Mobil Corporation) as a carrier, has low concentration (approximately 1 to 2 wt %) and low viscosity, and is volatile at room temperature. More specifically, the liquid developer D according to the present embodiment has a high viscosity (approximately 100 to 10000 mPa·s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 540 draws up the developer D, which is contained in the developer containing section 530, and carries it to the developer supplying roller 550. The lower section of the developer drawing roller 540 is immersed in the developer D contained in the developer containing section 530. The developer drawing roller 540 is separated from the developer supplying roller 550 at a distance of approximately 1 mm.

The developer drawing roller 540 is rotatable about its central axis. The central axis of the roller 540 is below the central axis of rotation of the developer supplying roller 550. Further, the developer drawing roller 540 rotates in the same direction (clockwise in FIG. 3) as the rotating direction of the developer supplying roller 550 (clockwise in FIG. 3). It should be noted that the developer drawing roller 540 not only has the function of drawing up the developer D contained in the developer containing section 530 and carrying it to the developer supplying roller 550, but also has the function of stirring the developer D in order to maintain the developer D in a suitable state.

The developer supplying roller 550 supplies the developer D, which has been carried from the developer containing section 530 by the developer drawing roller 540, to the developing roller 510. The developer supplying roller is made by providing helical grooves 550*a* (which serve as an example of depressions) at even pitches in the surface of a roller made of metal such as iron as shown in FIG. 4, and providing a nickel plating thereon. The diameter of the developer supplying roller 550 is approximately 25 mm. The developer supplying roller 550 of the present embodiment has, as the depressions, the grooves 550*a* which have a trapezoidal cross section as shown in FIG. 5A. It is instead possible to provide a multitude of recesses having a shape as shown, for example, in FIG. 5D or FIG. 5E in the developer supplying roller 550. Further, the grooves 550*a* do not have to have a shape as shown in FIG. 5A, and it is instead possible, for example, to provide grooves having a cross section in the shape of an inverted delta as shown in FIG. 5B, or grooves having a semicircular cross section as shown in FIG. 5C. It should be noted that the size of the grooves of the developer supplying roller 550 of the present embodiment is as shown in FIG. 5A: the groove pitch is approximately 170 μm, the width of the crest is approximately 45 μm, the width of the trough is approximately 30 μm, and the depth of the groove is approximately 50 μm.

Further, the surface of the developer supplying roller 550 is pressed in contact with a layer of an elastic body of the developing roller 510 (which is described later) in order to appropriately transfer the developer D on the developer supplying roller 550 to the developing roller 510. The developer supplying roller 550 is rotatable about its central axis, and the central axis thereof is below the central axis of rotation of the developing roller 510. Further, the developer supplying roller 550 rotates in the direction (clockwise in FIG. 3) opposite from the rotating direction of the developing roller 510 (counterclockwise in FIG. 3).

The restriction blade 560 abuts against the surface of the developer supplying roller 550 to restrict the amount of developer D on the developer supplying roller 550. More specifically, the restriction blade 560 serves as to scrape off any excessive developer on the developer supplying roller 550 to measure the developer D on the developer supplying roller 550, which is to be supplied to the developing roller 510. The restriction blade 560 is made of urethane rubber, which serves as the elastic body, and is supported by a restriction blade supporting member 562 made of metal such as iron. It should be noted that the rubber hardness of the restriction blade 560 is approximately 62 degrees in JIS (Japanese Industrial Standards) A scale, and the hardness of an abutting section of the restriction blade 560 where it abuts against the surface of the developer supplying roller 550 (which is approximately 62 degrees as described above) is smaller than the hardness of a press-contact section of the elastic body layer (described in detail later) of the developing roller 510 where it is pressed in contact with the surface of the developer supplying roller 550 (which is approximately 85 degrees).

The restriction blade 560 abuts against the surface of the developer supplying roller 550 with its edge 560*a*, and thus, carries out a so-called "edge restriction". Further, as shown in FIG. 6, the restriction blade 560 is arranged such that its tip end faces toward the downstream side of the rotating direction of the developer supplying roller 550, and thus, carries out a so-called "trailing restriction". As shown in FIG. 6, in the present embodiment, the "trailing angle" at which the restriction blade 560 trails is approximately 10 degrees.

The developing roller 510 bears the developer D and carries it to a developing position, which is in opposition to the photoconductor 20Y, in order to develop a latent image bore by the photoconductor 20Y with the developer D. The developing roller 510 has a layer of an elastic body, which serves as an example of an elastic section having conductivity, on the outer circumferential section of its inner core made of metal such as iron. The diameter of the developing roller 510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 510 is pressed in contact with the developer supplying roller 550 and the photoconductor 20Y in an elastically-deformed state, the above-mentioned surface layer serving as the press-contact section.

The developing roller 510 is rotatable about its central axis, and the central axis thereof is below the central axis of rotation of the photoconductor 20Y. Further, the developing roller 510 rotates in the direction (counterclockwise in FIG. 3) opposite from the rotating direction of the photoconductor 20Y (clockwise in FIG. 3). It should be noted that an electric field is generated between the developing roller 510 and the photoconductor 20Y when the latent image formed on the photoconductor 20Y is being developed.

The developing-roller cleaning unit 570 is a device that has a developing-roller cleaning blade 571, which is made of rubber and which is made to abut against the surface of the developing roller 510, and is for scraping off and removing the developer D remaining on the developing roller 510 with the developing-roller cleaning blade 571 after development has been carried out at the developing position.

In the yellow developing unit 50Y structured as above, the developer drawing roller 540 rotates about its central axis to draw up the developer D contained in the developer containing section 530 and to carry it to the developer supplying roller 550.

With the rotation of the developer supplying roller 550, the developer D that has been carried to the developer supplying roller 550 reaches an abutting position where the restriction blade 560 abuts against the roller 550. As the developer D on the roller 550 passes the abutting position, an excessive portion of the developer D is scraped off by the restriction blade 560, and thus, the amount of developer D to be supplied to the developing roller 510 is measured. That is, since the developer supplying roller 550 is provided with the grooves 550*a* as described above, the restriction blade 560, which abuts against the developer supplying roller 550, scrapes off the developer D on the developer supplying roller 550 except for the developer D that is retained in the grooves 550*a*. The dimension of the grooves 550*a* is determined in advance such that the amount of developer D to be supplied to the developing roller 510 becomes appropriate, so that when the restriction blade 560 scrapes off the developer D on the developer supplying roller 550, an appropriate amount of developer D, which has been suitably measured by means of the grooves 550*a*, will remain in the grooves 550*a*.

Figure 7:
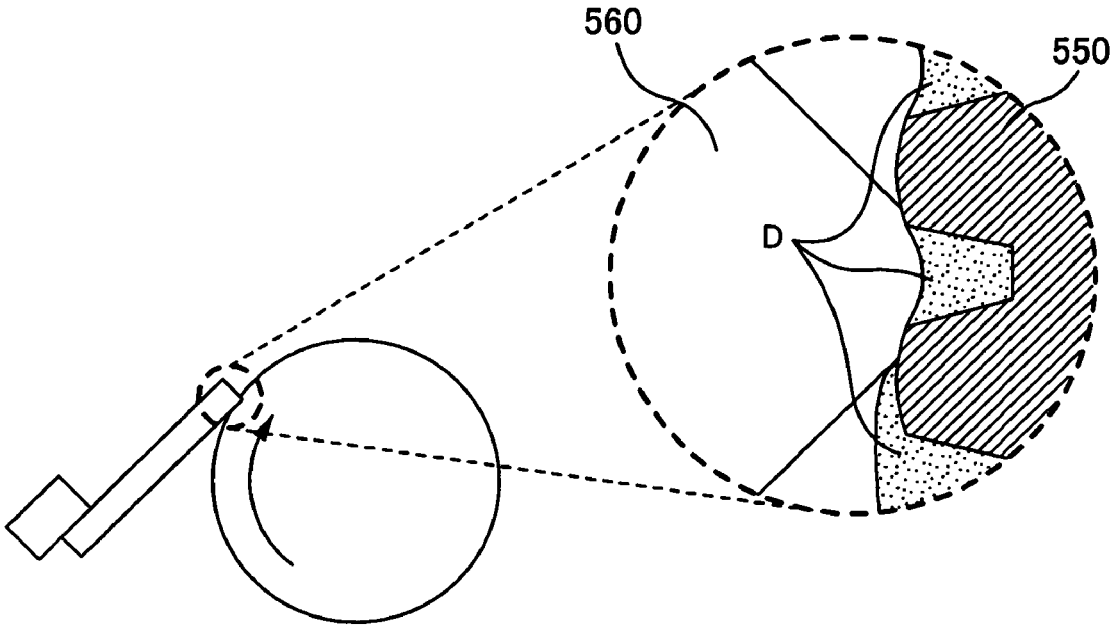
FIG. 7 is a conceptual diagram showing in enlargement how the restriction blade 560 abuts against the surface of the developer supplying roller 550 according to the first embodiment.

Now, attention is paid to FIG. 7. FIG. 7 is a conceptual diagram showing in enlargement how the restriction blade 560 abuts against the surface of the developer supplying roller 550. As described above, since the restriction blade 560 of the present embodiment is an elastic body, the restriction blade 560 can scrape off the developer D retained in the grooves 550*a* by elastically deforming and digging into the grooves 550*a* as shown in FIG. 7. Thus, the amount of the developer D, which is retained in the grooves 550*a* and whose amount has been restricted by the restriction blade 560, before being supplied to the developing roller 510 becomes smaller than the volumetric capacity of the grooves 550*a* which retain the developer D (see FIG. 9A).

With further rotation of the developer supplying roller 550, the developer D retained in the grooves 550*a* of the developer supplying roller 550 reaches a press-contact position where the roller 550 is pressed in contact with the developing roller 510. The developer D that has reached the press-contact position is transferred from the developer supplying roller 550 onto the developing roller 510 by the action of a pressure that is created as a result of the developer supplying roller 550 and the developing roller 510 being pressed in contact with each other, thereby forming a thin layer of developer D on the developing roller 510.

The thin layer of developer D formed on the developing roller 510 in this way is carried by the rotation of the developing roller 510 and arrives at the developing position in opposition to the photoconductor 20Y (i.e., a press-contact position where the roller 510 abuts against the photoconductor 20Y). Then the developer D is used at the developing position for developing the latent image formed on the photoconductor 20 under an electric field of a predetermined intensity. With further rotation of the developing roller 510, the developer D on the developing roller 510 that has passed the developing position reaches an abutting position where the developing-roller cleaning blade 571 abuts against the roller 510. When passing the abutting position, the developer D adhering to the surface of the developing roller 510 is scraped off by the developing-roller cleaning blade 571, and the scraped-off developer D is collected in a remaining-developer collector of the developing-roller cleaning unit 570.

As described above, in the present embodiment, the amount of the liquid developer, which is retained in the grooves 550*a* and whose amount has been restricted by the restriction blade 560, before being supplied to the developing roller 510 is smaller than the volumetric capacity of the grooves 550*a* that retain the liquid developer. In this way, it is possible to appropriately prevent occurrence of deterioration of image quality.

More specifically, as described in the section of the "Description of the Related Art", rivulets (mottled patterns such as bold streaks) may appear when the developer D, whose amount has been restricted by the restriction blade 560, is transferred from the developer supplying roller 550 to the developing roller 510. Formation of rivulets becomes significant when the amount of developer D retained in the grooves 550*a* before being supplied (transferred) to the developing roller 510 is equal to or more than the volumetric capacity of the grooves 550*a* retaining the developer D.

Figure 8A:
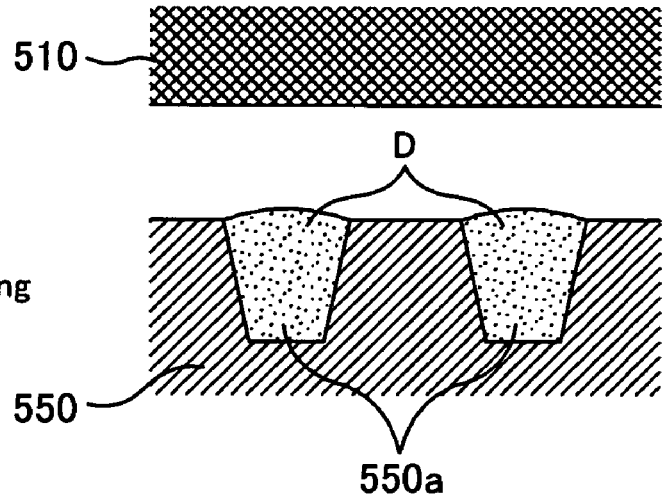
FIG. 8A through FIG. 8C are conceptual diagrams for describing an example in which rivulets are formed.
Figure 8B:
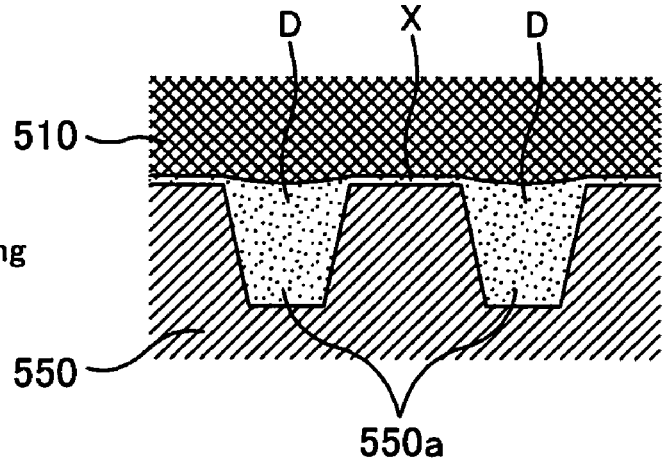
Figure 8C:
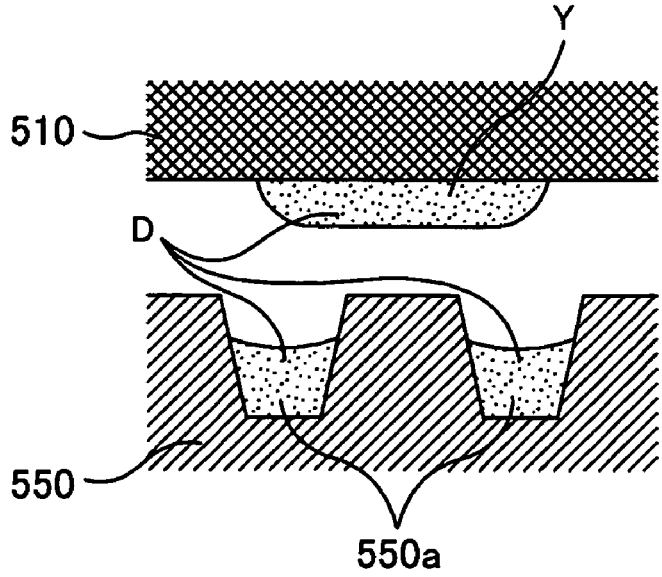

This is described in further detail with reference to FIG. 8A through FIG. 8C. FIG. 8A through FIG. 8C are conceptual diagrams for describing an example in which rivulets are formed, and are diagrams showing how the developer D retained in the grooves 550*a* is transferred to the developing roller 510. FIG. 8A shows a state before transferring is carried out, FIG. 8B shows a state during transferring, and FIG. 8C shows a state after transferring has completed.

FIG. 8A shows a state in which the amount of the developer D retained in the grooves 550*a* before being supplied (transferred) to the developing roller 510, is greater than the volumetric capacity of the grooves 550*a* retaining the developer D. If the developer D in this state is transferred to the developing roller 510, then, as shown in FIG. 8B, the developing roller 510 elastically deforms due to the action of a pressure that is created as a result of the developer supplying roller 550 and the developing roller 510 being pressed in contact with each other, and thus, the developing roller 510 digs into the grooves 550*a*. Then, the developing roller 510 digging into the grooves 550*a* causes the developer D, which is retained in the grooves 550*a*, to be squeezed out therefrom, and the squeezed-out developer D is moved to a position between the grooves 550*a* on the surface of the developer supplying roller 550 (for example, the position shown by the mark X in FIG. 8B). As a result, the developer D that was retained in separate adjacent grooves 550*a* merges into a single clump. If, under such circumstances, the press-contact between the developing roller 510 and the developer supplying roller 550 is released, then the developer D that was retained in separate adjacent grooves 550*a* merges together as shown in FIG. 8C, thereby forming a rivulet (a mottled pattern such as a bold streak; shown by the mark Y in FIG. 8C) on the developing roller 510. If the developer that has formed rivulets is used for developing the latent image bore by any of the photoconductors 20Y, 20M, 20C, and 20K to form an image, then the image quality will deteriorate.

On the other hand, in the present first embodiment of the invention, the amount of the developer D retained in the grooves 550*a* before being supplied (transferred) to the developing roller 510 is smaller than the volumetric capacity of the grooves 550*a* retaining the developer D. Formation of rivulets is prevented in this way.

Figure 9A:
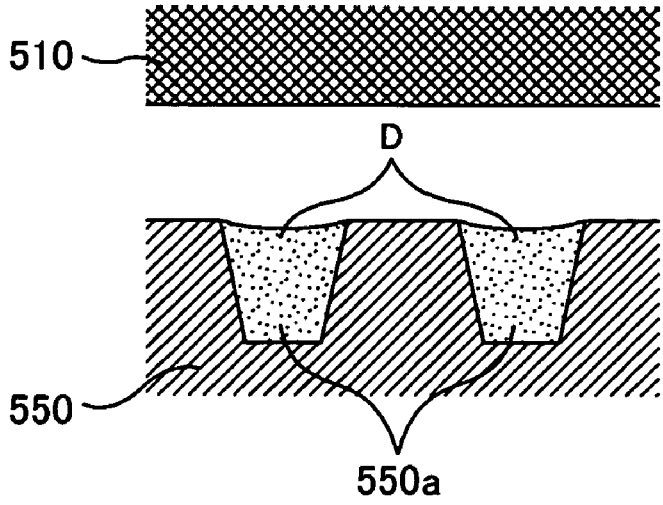
FIG. 9A through FIG. 9C are conceptual diagrams for describing an example in which rivulets are not formed according to the first embodiment.
Figure 9B:
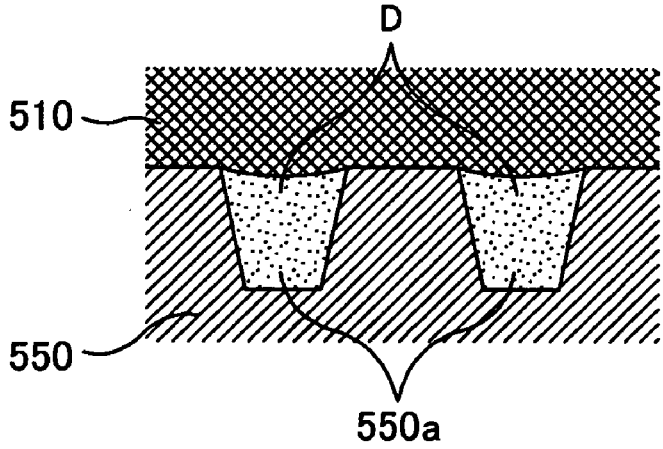
Figure 9C:
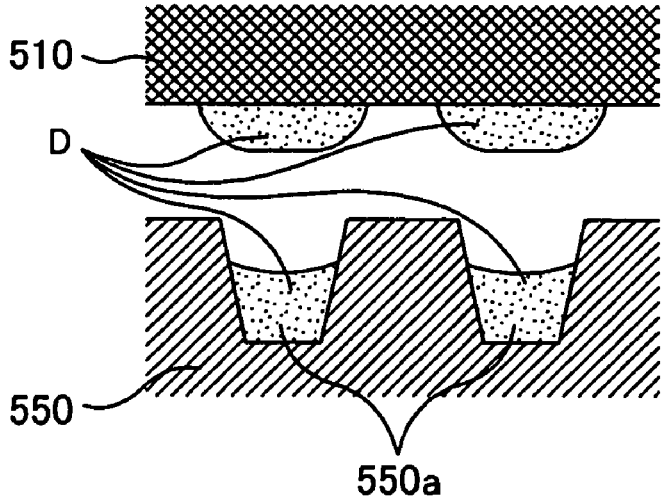

This is described in further detail with reference to FIG. 9A through FIG. 9C. FIG. 9A through FIG. 9C are conceptual diagrams for describing an example in which rivulets do not appear, and are diagrams showing how the developer D retained in the grooves 550*a* is transferred to the developing roller 510. FIG. 9A shows a state before transferring is carried out, FIG. 9B shows a state during transferring, and FIG. 9C shows a state after transferring has completed.

FIG. 9A shows a state in which the amount of the developer D retained in the grooves 550*a* before being supplied (transferred) to the developing roller 510, is smaller than the volumetric capacity of the grooves 550*a* retaining the developer D. As with the example shown in FIG. 8B, when the developer D in this state is transferred to the developing roller 510, the developing roller 510 digs into the grooves 550*a* as shown in FIG. 9B. However, in this example, the amount of the developer D retained in the grooves 550*a* before being supplied (transferred) to the developing roller 510, is smaller than the volumetric capacity of the grooves 550*a* retaining the developer D. Therefore, the above-described situation, that is, the situation in which the developer D retained in the grooves 550*a* is squeezed out therefrom and the developer D that was retained in separate adjacent grooves 550*a* merges into a single clump, does not occur. When the press-contact between the developing roller 510 and the developer supplying roller 550 is released in this state, no rivulets are formed as shown in FIG. 9C, and therefore, the developer D that has been measured to an appropriate amount by the grooves 550*a* will be transferred to the developing roller 510. Consequently, the above-described problem, that is, the problem that the image quality is deteriorated when the latent image bore by any of the photoconductors 20Y, 20M, 20C, and 20K is developed with the developer D that has formed rivulets to form an image, can be appropriately prevented from arising.

Method for Verifying the Amount of Developer Retained in the Grooves 550*a* and so Forth As described above, formation of rivulets is curbed when the amount of developer retained in the grooves 550*a* before being supplied (transferred) to the developing roller 510 is smaller than the volumetric capacity of the grooves 550*a* retaining the developer. Therefore, it is important to accurately determine whether the amount of developer retained in the grooves 550*a* is larger or smaller than the volumetric capacity of the grooves 550*a* retaining the developer. An example of a method for verifying this is described below.

In the verifying method described in this embodiment, the volumetric capacity of the grooves 550*a* retaining the developer and the amount of developer retained in the grooves 550*a* are obtained separately, and determination on whether the amount of developer retained in the grooves 550*a* is larger or smaller than the volumetric capacity of the grooves 550*a* retaining the developer is made by comparing the two obtained amounts.

Below, a method for obtaining the volumetric capacity of the grooves 550*a* retaining the developer and a method for obtaining the amount of developer retained in the grooves 550*a* are described in detail, separately.

Method for Obtaining the Volumetric Capacity of the Grooves 550*a* Retaining the Developer First, the cross-sectional shape of a groove 550*a* is measured using a laser microscope, for example, to obtain the cross sectional area A1 ($m^2$) of the groove 550*a*. Then, the number of grooves N1 (1/m) per unit length in the axial direction of the developer supplying roller 550 is obtained using, for example, a stereomicroscope or a microscope. By multiplying A1 and N1, the volumetric capacity of grooves V1 (=A1×N1) per unit area of the surface of the developer supplying roller 550 can be found.

If recesses such as those shown in FIG. 5D or FIG. 5E are adopted instead of the grooves 550*a*, then the shape of a recess is measured using a laser microscope, for example, to obtain the volumetric capacity A2 ($m^3$) of the recess. Then, the number of recesses N2 (1 $m^2$) per unit area of the surface of the developer supplying roller 550 is obtained using, for example, a stereomicroscope or a microscope. By multiplying A2 and N2, the volumetric capacity of recesses V2 (=A2×N2) per unit area of the surface of the developer supplying roller 550 can be found.

Method for Obtaining the Amount of Developer Retained in the Grooves 550*a*

The printer 10 is brought into operation, and when the rotating speed of the developer supplying roller 550 etc. becomes stable, the operation of the printer 10 is stopped. Then, a predetermined range having an area of A3 ($m^2$) is targeted from within a section on the surface of the developer supplying roller 550 positioned between the abutting position, where the restriction blade 560 abuts, and the press-contact position, where the developing roller 510 is pressed in contact, and the developer retained in the grooves 550*a*, or recesses, that exist within that range is collected from those grooves 550*a* or recesses. After collecting the developer, the weight M3 (kg) of the collected developer is obtained.

It should be noted that, as methods for collecting the developer and obtaining the weight of the collected developer, it is possible to adopt, for example, a method of transferring the developer onto a tape etc. and finding the weight M3 (kg) of the collected developer from the difference between the weight of the tape before transfer and the weight of the tape after transfer, or a method of absorbing the developer with an absorbent cotton and finding the weight M3 (kg) of the collected developer from the difference between the weight of the absorbent cotton before absorption and the weight of the absorbent cotton after absorption.

When the weight M3 (kg) of the developer is obtained, then, based on the weight M3 (kg), the above-described area A3 ($m^2$), and a known density of the developer ρ3 ($kg/m^3$), the amount of developer V3 (=M3/(A3×ρ3)) per unit area of the surface of the developer supplying roller 550, which is the amount of developer retained in the grooves 550*a*, can be found.

Other Considerations

In the foregoing embodiment, the restricting section was an elastic restriction blade 560; and the restriction blade 560 abutted against the surface of the developer supplying roller 550 to restrict the amount of the developer on the developer supplying roller 550. This, however, is not a limitation, and for example, it is possible to adopt the following means as the restricting section.

Figure 10:
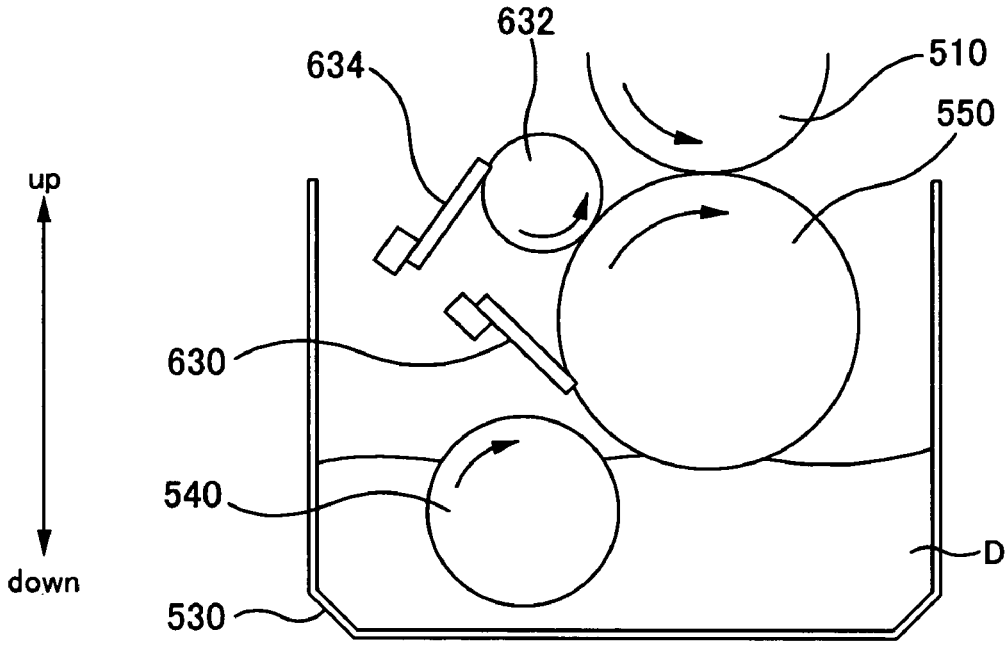
FIG. 10 is an explanatory diagram for describing another example of a restricting section.
Figure 11:
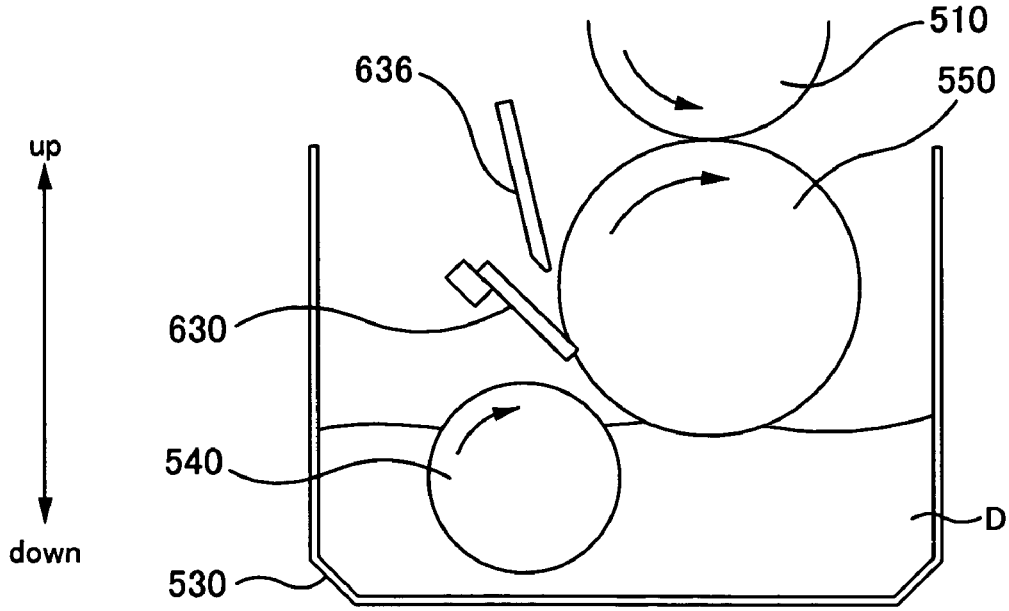
FIG. 11 is an explanatory diagram for describing another example of a restricting section.

Two examples of other types of restricting sections are described below with reference to FIG. 10 and FIG. 11. FIG. 10 and FIG. 11 are explanatory diagrams for describing other examples of the restricting section.

In the example of FIG. 10, the restricting section is made of a rigid restriction blade 630 and a developer sucking roller 632.

The rigid restriction blade 630 abuts against the surface of the developer supplying roller 550 to restrict the amount of developer D on the developer supplying roller 550. More specifically, the rigid restriction blade 630 scrapes off an excessive amount of developer on the developer supplying roller 550, but since the restriction blade 630 is not elastic, there is a high possibility that the amount of the developer D, which is retained in the grooves 550*a* and whose amount has been restricted by the restriction blade 630, becomes equal to or larger than the volumetric capacity of the grooves 550*a* that retain the developer D (i.e., the developer D is in the state shown in FIG. 8A). It should be noted that in the example of FIG. 10, the restriction blade 630 is arranged such that its tip end faces toward the upstream side of the rotating direction of the developer supplying roller 550, thereby carrying out so-called "counter restriction". This, however, is not a limitation, and for example, its tip end may face toward the downstream side of the rotating direction of the developer supplying roller 550 to carry out so-called "trailing restriction".

The developer sucking roller 632 is a roller provided with an elastic body layer that is made of urethane rubber, which has a thickness of approximately 2 mm and a rubber hardness of approximately 40 degrees in JIS-A, on the outer circumferential section of an inner core made of metal such as iron. The diameter of the developer sucking roller 632 is approximately 10 mm. The developer sucking roller 632 is provided on the downstream side, with respect to the restriction blade 630, of the rotating direction of the developer supplying roller 550. The elastic body layer of the developer sucking roller 632 serves as a press-contact section and is pressed in contact with the developer supplying roller 550 in an elastically deformed state. Further, the developer sucking roller 632 is rotatable about its central axis, and the central axis thereof is positioned above the central axis of rotation of the developer supplying roller 550. The developer sucking roller 632 rotates in a direction (counterclockwise in FIG. 10) opposite from the rotating direction of the developer supplying roller 550 (clockwise in FIG. 10).

The developer sucking roller 632 structured as above functions as to suck out a portion of the developer D, which is retained in the grooves 550*a* and whose amount has been restricted by the restriction blade 630, by rotating in a state pressed in contact with the developer supplying roller 550, which is also rotating. According to the function of the developer sucking roller 632, the amount of developer D, which was equal to or greater than the volumetric capacity of the grooves 550*a*, becomes smaller than the volumetric capacity of the grooves 550*a*. That is, the state of the developer D shifts from the state shown in FIG. 8A to the state shown in FIG. 9A.

It should be noted that the developer D that has been sucked by the developer sucking roller 632 is scraped off by a cleaning blade 634 that abuts against the developer sucking roller 632.

Further, in the example of FIG. 11, the restricting section is made of a rigid restriction blade 630 and an air knife 636.

As with the example of FIG. 10, the rigid restriction blade 630 abuts against the surface of the developer supplying roller 550 to restrict the amount of developer D on the developer supplying roller 550, but there is a high possibility that the amount of the developer D that is retained in the grooves 550*a* after the amount thereof has been restricted becomes equal to or larger than the volumetric capacity of the grooves 550*a* that retain the developer D (i.e., the developer D is in the state shown in FIG. 8A).

On the other hand, in the example of FIG. 11, instead of the developer sucking roller 632, an air knife 636 is provided on the downstream side, with respect to the restriction blade 630, of the rotating direction of the developer supplying roller 550. The air knife 636 functions as to remove a portion of the developer D that is retained in the grooves 550*a* and whose amount has been restricted by the restriction blade 630. According to the function of the air knife 636, the amount of developer D, which was equal to or greater than the volumetric capacity of the grooves 550*a*, becomes smaller than the volumetric capacity of the grooves 550*a*. That is, the state of the developer D shifts from the state shown in FIG. 8A to the state shown in FIG. 9A.

As described above, it is possible to make the amount of developer D retained in the grooves 550*a* smaller than the volumetric capacity of the grooves 550*a* that retain the developer D (i.e., make the developer D be in the state shown in FIG. 9A) by adopting any one of the elastic restriction blade 560, the example of FIG. 10, and the example of FIG. 11, as the restricting section. The foregoing embodiment, however, is more preferable in terms that the structure of the restricting section can be made simple.

Further, in the foregoing embodiment, the developing roller 510 had an elastic body layer; and the surface of the developer supplying roller 550 was pressed in contact with the elastic body layer in order for the developer supplying roller 550 to supply the developer D to the developing roller 510. This, however, is not a limitation. For example, the surface of the developer supplying roller may be pressed in contact with a layer of a rigid body provided on the developing roller in order for the developer supplying roller to supply the developer to the developing roller.

The foregoing embodiment, however, is more preferable in terms that the developer D is transferred from the developer supplying roller 550 to the developing roller 510 more appropriately.

Further, in the foregoing embodiment, the hardness of an abutting section of the restriction blade 560 (approximately 62 degrees) where the restriction blade 560 abuts against the surface of the developer supplying roller 550 was smaller than the hardness of a press-contact section of the elastic body layer of the developing roller 510 (approximately 85 degrees) where the elastic body layer is pressed in contact with the surface of the developer supplying roller 550. This, however, is not a limitation. For example, the hardness of the abutting section may be larger than the hardness of the press-contact section.

However, if the hardness of the abutting section is larger than the hardness of the press-contact section, the restriction blade will not dig into the grooves appropriately, thereby making the formation of rivulets more significant. On the other hand, the elastic body layer of the developing roller will dig into the grooves too much, thereby causing an excessive amount of developer to be transferred to the developing roller. The foregoing embodiment, in which the hardness of the abutting section is smaller than the hardness of the press-contact section, is therefore more preferable in terms that the above-mentioned disadvantages do not arise.

Further, in the foregoing embodiment, the rotating direction of the developing roller 510 was opposite from the rotating direction of the developer supplying roller 550. This, however, is not a limitation. For example, the rotating direction of the developing roller 510 may be in the same direction as the rotating direction of the developer supplying roller 550.

However, if the rotating direction of the developing roller is in the same direction as the rotating direction of the developer supplying roller, an excessive rotational resistance occurs at the press-contact sections because the developing roller and the developer supplying roller rotate while being pressed in contact with each other. Therefore, it is more preferable that the rotating direction of the developing roller 510 is opposite from the rotating direction of the developer supplying roller 550 in terms that the above-described disadvantage does not arise.

Further, in the foregoing embodiment, the developer supplying roller 550 was made of metal. This, however, is not a limitation, and for example, the developer supplying roller may be made of a material other than metal.

The foregoing embodiment, however, is more preferable in terms that, by making the developer supplying roller 550 out of metal, it is possible to make the restriction blade 560 and the elastic body layer of the developing roller 510 dig into the grooves 550*a* of the developer supplying roller 550 more appropriately.

Further, in the foregoing embodiment, the restriction blade 560 and the elastic body layer of the developing roller 510 were both made of rubber. This, however, is not a limitation, and they may be made of any kind of material as long as it is elastic.

Further, in the foregoing embodiment, non-volatile liquid developer D that is non-volatile at room temperature was used as the developer. This, however, is not a limitation. For example, the developer may be volatile liquid developer which employs Isopar (trademark: Exxon Mobil Corporation) as a carrier, has low concentration (approximately 1 to 2 wt %) and low viscosity, and is volatile at room temperature.

Non-volatile liquid developer, which is non-volatile at room temperature, is made to have a high viscosity in order to make it non-volatile. When high-viscosity liquid developer is used in the above-described developing device, rivulets tend to be formed due to the high viscosity of the liquid developer. The foregoing embodiment is therefore more effective in terms that the above-mentioned effect, that is, the effect of being able to curb the formation of rivulets and prevent deterioration of image quality, is achieved more advantageously.

Second Embodiment of the Developing Unit etc.

Configuration Example of Developing Unit

Figure 12:
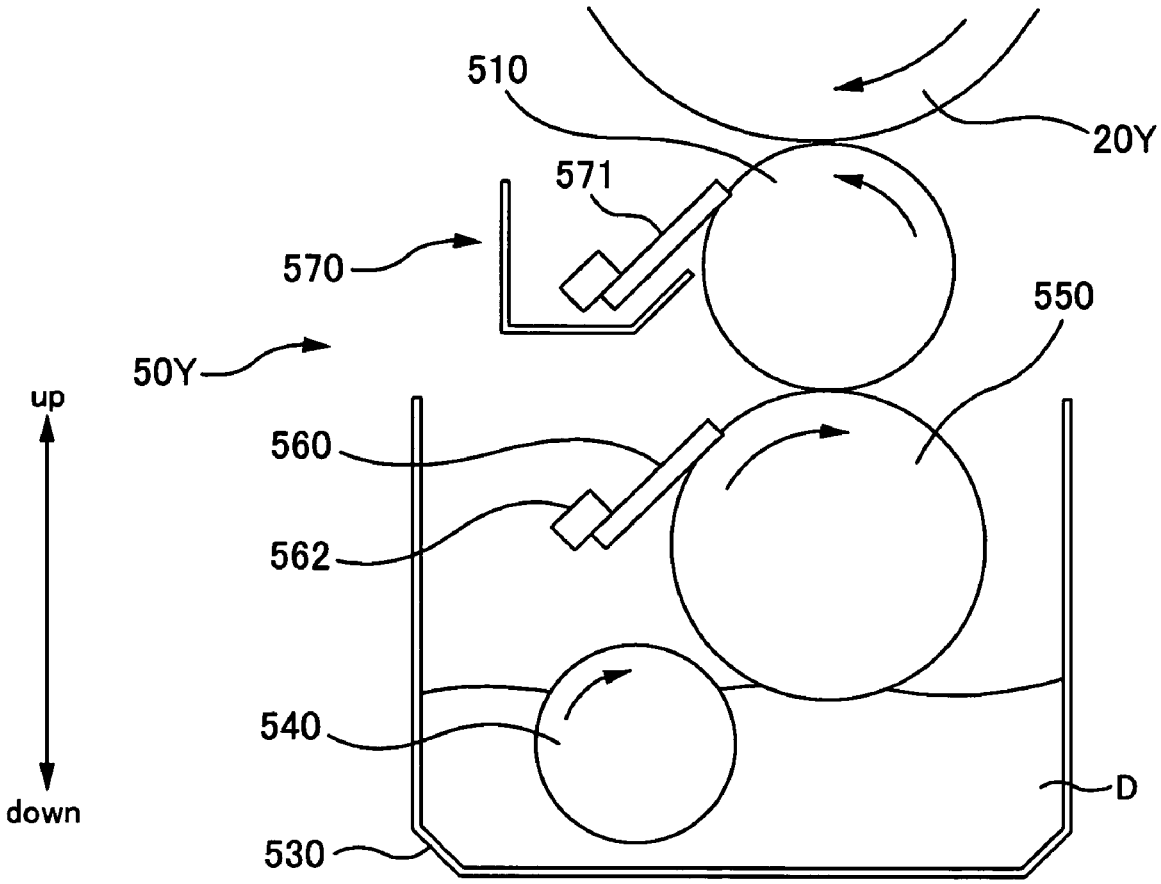
FIG. 12 is a section view showing main structural components of a developing unit according to a second embodiment.
Figure 13:
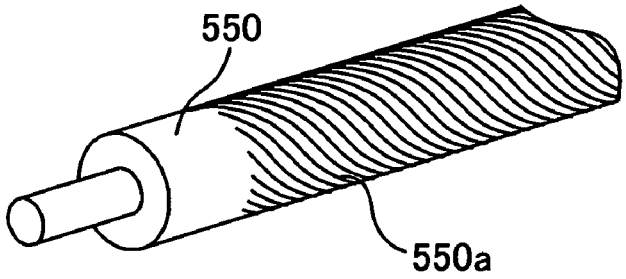
FIG. 13 is a perspective view conceptually showing the surface of a developer supplying roller 550 according to the second embodiment.

Next, with reference to FIG. 12 through FIG. 15, an example of a configuration of a developing unit according to the second embodiment is described below. FIG. 12 is a section view showing main structural components of a developing unit. FIG. 13 is a perspective view conceptually showing the surface of a developer supplying roller 550. FIG. 14A through FIG. 14C are section views of the shapes of grooves provided in the surface of the developer supplying roller 550. FIG. 15 is a schematic diagram showing "trailing restriction" of the restriction blade 560. It should be noted that in FIG. 12, the arrow indicates the vertical direction as in FIG. 1, and, for example, the developing roller 510 is positioned above the developer drawing roller 540.

The printer 10 has, as developing units, a black developing unit 50K containing black (K) developer, a magenta developing unit 50M containing magenta (M) developer, a cyan developing unit 50C containing cyan (C) developer, and a yellow developing unit 50Y containing yellow (Y) developer. Since the structure of each developing unit is substantially the same, only the yellow developing unit 50Y is described in detail below.

The yellow developing unit 50Y has a developing roller 510 serving as an example of a developer bearing body, a developer containing section 530, a developer drawing roller 540, a developer supplying roller 550 serving as an example of a developer supplying member, a restriction blade 560 serving as an example of a restriction member, and a developing-roller cleaning unit 570.

The developer containing section 530 contains developer D which is for developing a latent image formed on the photoconductor 20Y. The type of developer D contained in the developer containing section 530 is a high-concentration, high-viscosity, non-volatile liquid developer D that is non-volatile at room temperature, and is not the general, conventional volatile liquid developer which employs Isopar (trademark: Exxon Mobil Corporation) as a carrier, has low concentration (approximately 1 to 2 wt %) and low viscosity, and is volatile at room temperature. More specifically, the liquid developer D according to the present embodiment has a high viscosity (approximately 100 to 10000 mpa·s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 540 draws up the developer D, which is contained in the developer containing section 530, and carries it to the developer supplying roller 550. The lower section of the developer drawing roller 540 is immersed in the developer D contained in the developer containing section 530. The developer drawing roller 540 is separated from the developer supplying roller 550 at a distance of approximately 1 mm.

The developer drawing roller 540 is rotatable about its central axis. The central axis of the roller 540 is below the central axis of rotation of the developer supplying roller 550. Further, the developer drawing roller 540 rotates in the same direction (clockwise in FIG. 12) as the rotating direction of the developer supplying roller 550 (clockwise in FIG. 12). It should be noted that the developer drawing roller 540 not only has the function of drawing up the developer D contained in the developer containing section 530 and carrying it to the developer supplying roller 550, but also has the function of stirring the developer D in order to maintain the developer D in a suitable state.

The developer supplying roller 550 supplies the developer D, which has been carried from the developer containing section 530 by the developer drawing roller 540, to the developing roller 510. The developer supplying roller is made by providing helical grooves 550*a* (which serve as an example of depressions) at even pitches in the surface of a roller made of metal such as iron as shown in FIG. 13, and providing a nickel plating thereon. The diameter of the developer supplying roller 550 is approximately 25 mm. The developer supplying roller 550 of the present embodiment has, as grooves, the grooves 550*a* which have a trapezoidal cross section as shown in FIG. 14A. It is instead possible, for example, to provide grooves having a cross section in the shape of an inverted delta as shown in FIG. 14B, or grooves having a semicircular cross section as shown in FIG. 14C. It should be noted that the size of the grooves of the developer supplying roller 550 of the present embodiment is as shown in FIG. 14A: the groove pitch is approximately 170 μm, the width of the crest is approximately 45 μm, the width of the trough is approximately 30 μm, and the depth of the groove is approximately 50 μm.

Further, the surface of the developer supplying roller 550 is pressed in contact with a layer of an elastic body of the developing roller 510 (which is described later) in order to appropriately transfer the developer D on the developer supplying roller 550 to the developing roller 510. The developer supplying roller 550 is rotatable about its central axis, and the central axis thereof is below the central axis of rotation of the developing roller 510. Further, the developer supplying roller 550 rotates in the direction (clockwise in FIG. 12) opposite from the rotating direction of the developing roller 510 (counterclockwise in FIG. 12).

The restriction blade 560 abuts against the surface of the developer supplying roller 550 to restrict the amount of developer D on the developer supplying roller 550. More specifically, the restriction blade 560 serves as to scrape off any excessive developer on the developer supplying roller 550 to measure the developer D on the developer supplying roller 550, which is to be supplied to the developing roller 510. The restriction blade 560 is made of urethane rubber, which serves as the elastic body, and is supported by a restriction blade supporting member 562 made of metal such as iron. It should be noted that the rubber hardness of the restriction blade 560 is approximately 62 degrees in JIS (Japanese Industrial Standards) A scale, and the hardness of an abutting section of the restriction blade 560 where it abuts against the surface of the developer supplying roller 550 (which is approximately 62 degrees as described above) is smaller than the hardness of a press-contact section of the elastic body layer (described in detail later) of the developing roller 510 where it is pressed in contact with the surface of the developer supplying roller 550 (which is approximately 85 degrees).

The restriction blade 560 abuts against the surface of the developer supplying roller 550 with its edge 560*a*, and thus, carries out a so-called "edge restriction". Further, as shown in FIG. 15, the restriction blade 560 is arranged such that its tip end faces toward the downstream side of the rotating direction of the developer supplying roller 550, and thus, carries out a so-called "trailing restriction". As shown in FIG. 15, in the present embodiment, the "trailing angle" at which the restriction blade 560 trails is approximately 10 degrees.

The developing roller 510 bears the developer D and carries it to a developing position, which is in opposition to the photoconductor 20Y, in order to develop a latent image bore by the photoconductor 20Y with the developer D. The developing roller 510 has a layer of an elastic body, which serves as an example of an elastic section having conductivity, on the outer circumferential section of its inner core made of metal such as iron. The diameter of the developing roller 510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 510 is pressed in contact with the developer supplying roller 550 and the photoconductor 20Y in an elastically-deformed state, the above-mentioned surface layer serving as the press-contact section.

The developing roller 510 is rotatable about its central axis, and the central axis thereof is below the central axis of rotation of the photoconductor 20Y. Further, the developing roller 510 rotates in the direction (counterclockwise in FIG. 12) opposite from the rotating direction of the photoconductor 20Y (clockwise in FIG. 12). It should be noted that an electric field is generated between the developing roller 510 and the photoconductor 20Y when the latent image formed on the photoconductor 20Y is being developed.

The developing-roller cleaning unit 570 is a device that has a developing-roller cleaning blade 571, which is made of rubber and which is made to abut against the surface of the developing roller 510, and is for scraping off and removing the developer D remaining on the developing roller 510 with the developing-roller cleaning blade 571 after development has been carried out at the developing position.

In the yellow developing unit 50Y structured as above, the developer drawing roller 540 rotates about its central axis to draw up the developer D contained in the developer containing section 530 and to carry it to the developer supplying roller 550.

With the rotation of the developer supplying roller 550, the developer D that has been carried to the developer supplying roller 550 reaches an abutting position where the restriction blade 560 abuts against the roller 550. As the developer D on the roller 550 passes the abutting position, an excessive portion of the developer D is scraped off by the restriction blade 560, and thus, the amount of developer D to be supplied to the developing roller 510 is measured. That is, since the developer supplying roller 550 is provided with the grooves 550*a* as described above, the restriction blade 560, which abuts against the developer supplying roller 550, scrapes off the developer D on the developer supplying roller 550 except for the developer D that is retained in the grooves 550*a*. The dimension of the grooves 550*a* is determined in advance such that the amount of developer D to be supplied to the developing roller 510 becomes appropriate, so that when the restriction blade 560 scrapes off the developer D on the developer supplying roller 550, an appropriate amount of developer D, which has been suitably measured by means of the grooves 550*a*, will remain in the grooves 550*a*.

With further rotation of the developer supplying roller 550, the developer D retained in the grooves 550*a* of the developer supplying roller 550 reaches a press-contact position where the roller 550 is pressed in contact with the developing roller 510. The developer D that has reached the press-contact position is transferred from the developer supplying roller 550 onto the developing roller 510 by the action of a pressure that is created as a result of the developer supplying roller 550 and the developing roller 510 being pressed in contact with each other, thereby forming a thin layer of developer D on the developing roller 510.

The thin layer of developer D formed on the developing roller 510 in this way is carried by the rotation of the developing roller 510 and arrives at the developing position in opposition to the photoconductor 20Y (i.e., a press-contact position where the roller 510 abuts against the photoconductor 20Y). Then the developer D is used at the developing position for developing the latent image formed on the photoconductor 20 under an electric field of a predetermined intensity. With further rotation of the developing roller 510, the developer D on the developing roller 510 that has passed the developing position reaches an abutting position where the developing-roller cleaning blade 571 abuts against the roller 510. When passing the abutting position, the developer D adhering to the surface of the developing roller 510 is scraped off by the developing-roller cleaning blade 571, and the scraped-off developer D is collected in a remaining-developer collector of the developing-roller cleaning unit 570.

Mechanism According to which Rivulets are Formed

Figure 16A:
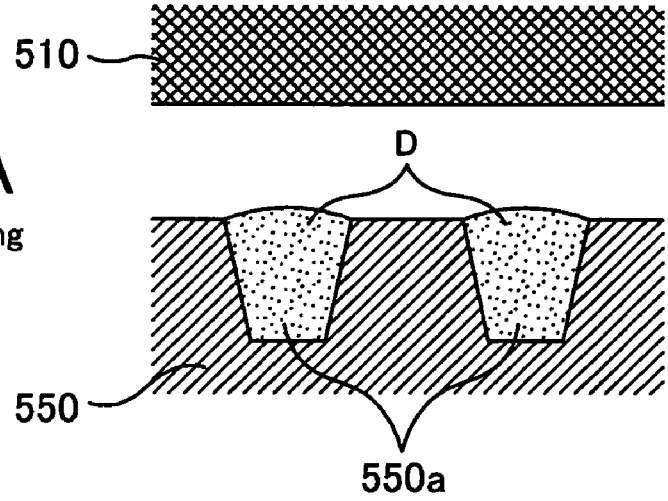
FIG. 16A through FIG. 16C are conceptual diagrams for describing an example in which rivulets are formed.
Figure 16B:
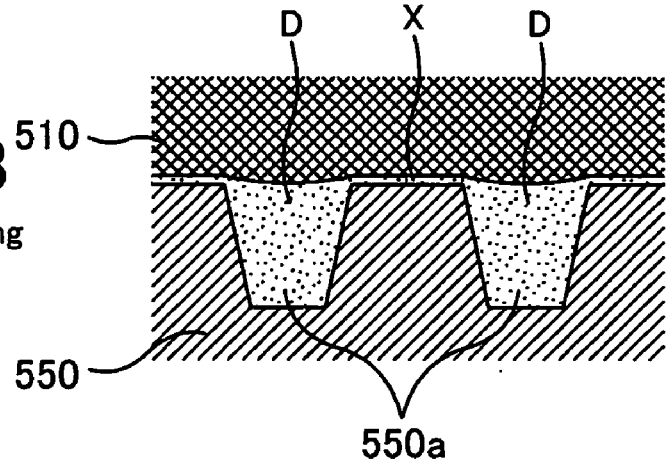
Figure 16C:
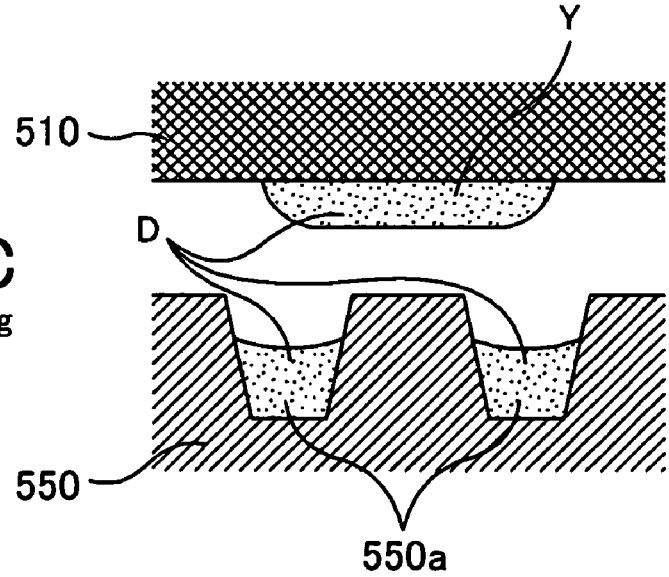
Figure 17A:
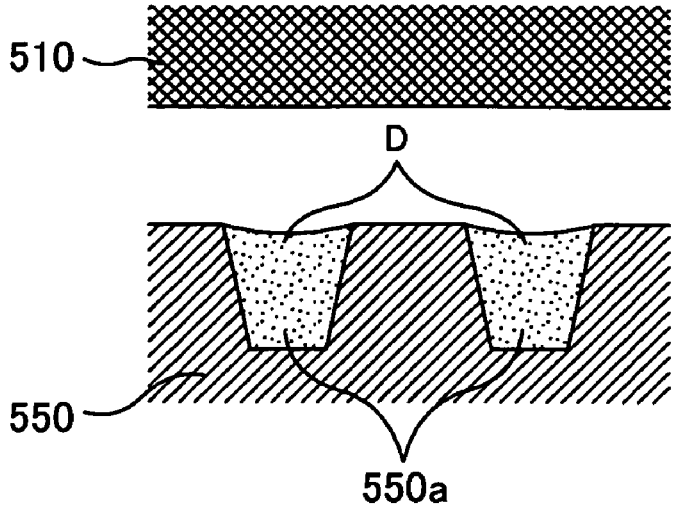
FIG. 17A through FIG. 17C are conceptual diagrams for describing an example in which rivulets are not formed according to the second embodiment.
Figure 17B:
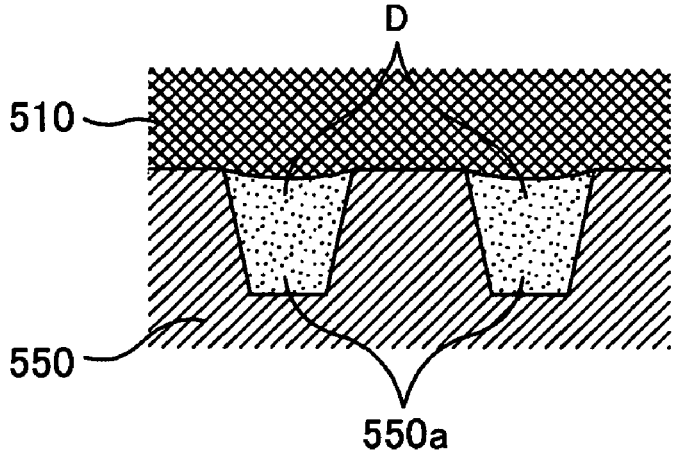
Figure 17C:
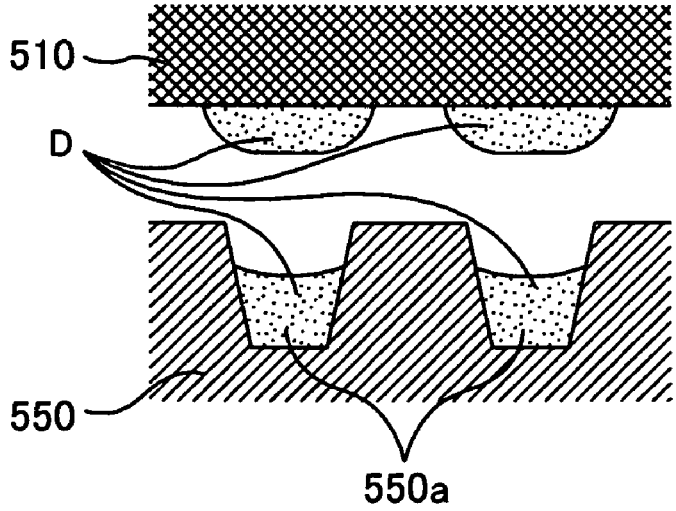

As described in the section of the "Description of the Related Art", rivulets (mottled patterns such as bold streaks) may appear when the developer D, whose amount has been restricted by the restriction blade 560, is transferred from the developer supplying roller 550 to the developing roller 510. Below, the mechanism according to which these rivulets are formed is described by comparing an example in which rivulets are formed and an example in which rivulets are not formed, with reference to FIG. 16A through FIG. 16C and FIG. 17A through FIG. 17C. FIG. 16A through FIG. 16C and FIG. 17A through FIG. 17C are conceptual diagrams showing how the developer D retained in the grooves 550*a* is transferred to the developing roller 510. FIG. 16A through FIG. 16C are conceptual diagrams for describing an example in which rivulets are formed. FIG. 17A through FIG. 17C are conceptual diagrams for describing an example in which rivulets are not formed. FIG. 16A and FIG. 17A show a state before transferring is carried out, FIG. 16B and FIG. 17B show a state during transferring, and FIG. 16C and FIG. 17C shows a state after transferring has completed.

As described above, the developer D on the developer supplying roller 550 that has reached the abutting position of the restriction blade 560 is scraped off at the abutting position except for the portion of the developer D retained in the grooves 550*a*. The developer D retained in the grooves 550*a* is carried to the press-contact position where the roller 550 is pressed in contact with the developing roller 510, and is transferred to the developing roller 510.

Now, attention is paid to FIG. 16A and FIG. 17A. FIG. 16A and FIG. 17A show the developer D, which is retained in the grooves 550*a* and whose amount has been restricted by the restriction blade 560, before being supplied (transferred) to the developing roller 510. As it is clear from FIG. 16A and FIG. 17A, the amount of developer D retained in the grooves 550*a* differs between the two figures. That is, in FIG. 16A, the amount of the developer D retained in the grooves 550*a* before being supplied (transferred) to the developing roller 510, is greater than the volumetric capacity of the grooves 550*a* retaining the developer D, whereas in FIG. 17A, the amount of the developer D retained in the grooves 550*a* before being supplied (transferred) to the developing roller 510, is smaller than the volumetric capacity of the grooves 550*a* retaining the developer D.

Next, discussion is made on how the developer D, which is in the state shown in FIG. 16A, is transferred to the developing roller 510. When the developer D retained in the grooves 550*a* is transferred to the developing roller 510, then, as shown in FIG. 16B, the developing roller 510 elastically deforms due to the action of a pressure that is created as a result of the developer supplying roller 550 and the developing roller 510 being pressed in contact with each other, and thus, the developing roller 510 digs into the grooves 550*a*. Then, the developing roller 510 digging into the grooves 550*a* causes the developer D, which is retained in the grooves 550*a*, to be squeezed out therefrom, and the squeezed-out developer D is moved to a position between the grooves 550*a* on the surface of the developer supplying roller 550 (for example, the position shown by the mark X in FIG. 16B). As a result, the developer D that was retained in separate adjacent grooves 550*a* merges into a single clump.

When, under such circumstances, the press-contact between the developing roller 510 and the developer supplying roller 550 is released, the developer D that was retained in separate adjacent grooves 550*a* merges together as shown in FIG. 16C, thereby forming a rivulet (a mottled pattern such as a bold streak; shown by the mark Y in FIG. 16C) on the developing roller 510.

Next, discussion is made on how the developer D, which is in the state shown in FIG. 17A, is transferred to the developing roller 510. As with the example shown in FIG. 16B, when the developer D retained in the grooves 550*a* is transferred to the developing roller 510, the developing roller 510 digs into the grooves 550*a* as shown in FIG. 17B. However, in this example, the amount of the developer D retained in the grooves 550*a* before being supplied (transferred) to the developing roller 510, is smaller than the volumetric capacity of the grooves 550*a* retaining the developer D. Therefore, the above-described situation, that is, the situation in which the developer D retained in the grooves 550*a* is squeezed out therefrom and the developer D that was retained in separate adjacent grooves 550*a* merges into a single clump, does not occur.

Therefore, when the press-contact between the developing roller 510 and the developer supplying roller 550 is released in this state, no rivulets are formed as shown in FIG. 17C, and therefore, the developer D that has been measured to an appropriate amount by the grooves 550*a* will be transferred to the developing roller 510.

As it is clear from the above discussions, the formation of rivulets has a relation to the amount of developer D, which is retained in the grooves 550*a* and whose amount has been restricted by the restriction blade 560, before being supplied (transferred) to the developing roller 510. More specifically, formation of rivulets becomes significant when the amount of developer D is equal to or more than the volumetric capacity of the grooves 550*a* retaining the developer D, whereas formation of rivulets is curbed when the amount of developer D is smaller than the volumetric capacity of the grooves 550*a* retaining the developer D.

Restriction Effect of the Elastic Restriction Blade

As described above, the restriction blade 560 according to the present second embodiment is an elastic body. By restricting the amount of developer on the developer supplying roller 550 by means of such an elastic restriction blade 560, it is possible to appropriately prevent deterioration of image quality.

More specifically, as described in the section of the "Description of the Related Art", the developer D whose amount has been restricted by the restriction blade 560 is transferred from the developer supplying roller 550 to the developing roller 510, but there are cases in which rivulets appear in the developer D that has been transferred to the developing roller 510. If the developer D that has formed rivulets is used for developing the latent image bore by any of the photoconductors 20Y, 20M, 20C, and 20K to form an image, then the image quality will deteriorate.

Further, as described in the section of the "Mechanism according to which rivulets are formed", formation of rivulets becomes significant when the amount of developer D, which is retained in the grooves 550*a* and whose amount has been restricted by the restriction blade 560, before being supplied (transferred) to the developing roller 510 is equal to or more than the volumetric capacity of the grooves 550*a* retaining the developer D.

Figure 18:
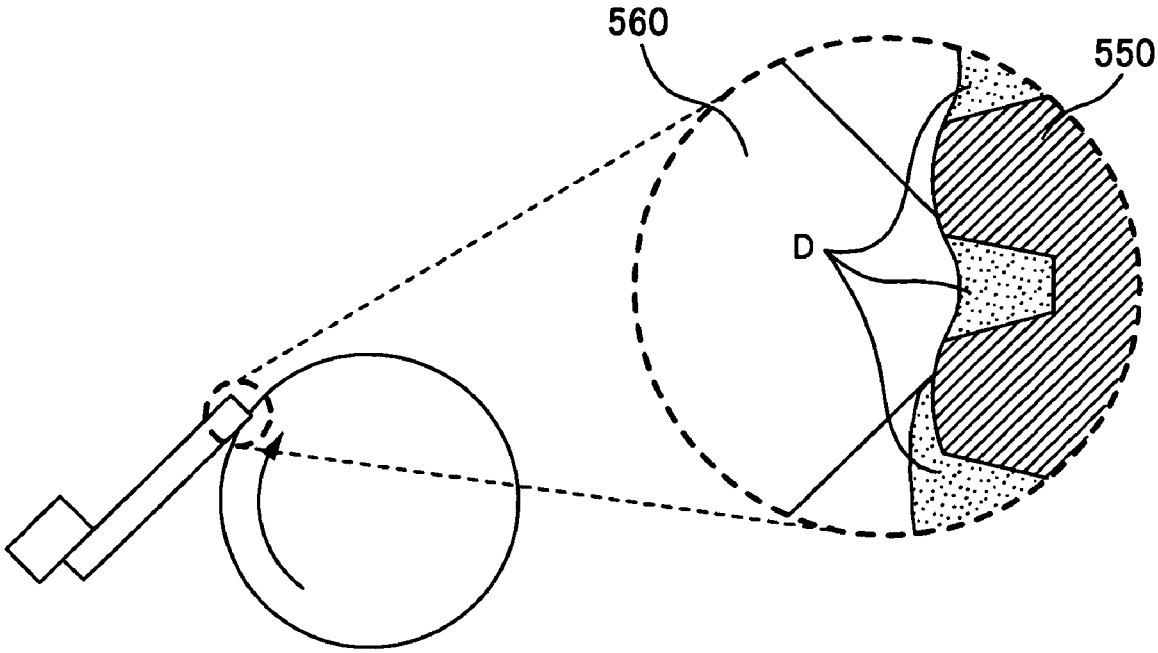
FIG. 18 is a conceptual diagram showing in enlargement how the restriction blade 560 abuts against the surface of the developer supplying roller 550 according to the second embodiment.

In view of the above, the amount of developer on the developer supplying roller 550 is restricted by an elastic restriction blade 560. In this way, the restriction blade 560 can scrape off the developer D retained in the grooves 550*a* by elastically deforming and digging into the grooves 550*a* as shown in FIG. 18. Thus, it is possible to easily make the amount of the developer D, which is retained in the grooves 550*a* and whose amount has been restricted, smaller than the volumetric capacity of the grooves 550*a*, which retain the developer D, by means of the elastic restriction blade 560.

Therefore, formation of rivulets is curbed, and consequently, the above-described problem, that is, the problem that the image quality is deteriorated when the latent image bore by any of the photoconductors 20Y, 20M, 20C, and 20K is developed with the developer D that has formed rivulets to form an image, can be appropriately prevented from arising.

It should be noted that FIG. 18 is a conceptual diagram showing in enlargement how the restriction blade 560 abuts against the surface of the developer supplying roller 550.

Other Considerations

Figure 19A:
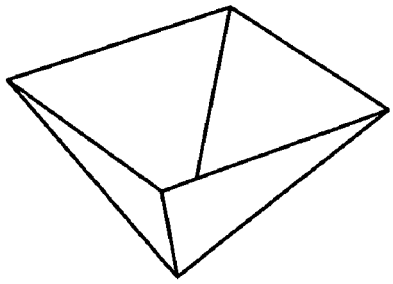
FIG. 19A and FIG. 19B show the shapes of recesses provided in the developer supplying roller 550.
Figure 19B:
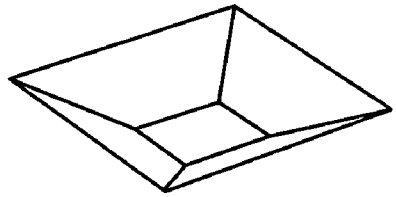

In the foregoing embodiment, grooves 550*a* were described as an example of the depressions provided in the developer supplying roller 550. Instead, a multitude of recesses of a shape as shown, for example, in FIG. 19A or FIG. 19B may be provided in the developer supplying roller 550 as the depressions. It should be noted that FIG. 19A and FIG. 19B show the shapes of recesses provided in the developer supplying roller 550.

Further, in the foregoing embodiment, the hardness of an abutting section of the restriction blade 560 (approximately 62 degrees) where the restriction blade 560 abuts against the surface of the developer supplying roller 550 was smaller than the hardness of a press-contact section of the elastic body layer of the developing roller 510 (approximately 85 degrees) where the elastic body layer is pressed in contact with the surface of the developer supplying roller 550. This, however, is not a limitation. For example, the hardness of the abutting section may be larger than the hardness of the press-contact section.

However, if the hardness of the abutting section is larger than the hardness of the press-contact section, the restriction blade will not dig into the grooves appropriately, thereby making the formation of rivulets more significant. On the other hand, the elastic body layer of the developing roller will dig into the grooves too much, thereby causing an excessive amount of developer to be transferred to the developing roller. The foregoing embodiment, in which the hardness of the abutting section is smaller than the hardness of the press-contact section, is therefore more preferable in terms that the above-mentioned disadvantages do not arise.

Further, in the foregoing embodiment, the rotating direction of the developing roller 510 was opposite from the rotating direction of the developer supplying roller 550. This, however, is not a limitation. For example, the rotating direction of the developing roller 510 may be in the same direction as the rotating direction of the developer supplying roller 550.

However, if the rotating direction of the developing roller is in the same direction as the rotating direction of the developer supplying roller, an excessive rotational resistance occurs at the press-contact sections because the developing roller and the developer supplying roller rotate while being pressed in contact with each other. Therefore, it is more preferable that the rotating direction of the developing roller 510 is opposite from the rotating direction of the developer supplying roller 550 in terms that the above-described disadvantage does not arise.

Further, in the foregoing embodiment, the restriction blade 560 abutted against the surface of the developer supplying roller 550 at its edge 560*a* to restrict the amount of the developer D on the developer supplying roller 550. This, however, is not a limitation. For example, the restriction blade may abut against the surface of the developer supplying roller at a section around its center.

The foregoing embodiment, however, is more preferable in terms that it is possible to scrape off the developer D on the developer supplying roller 550 more appropriately.

Further, in the foregoing embodiment, the developer supplying roller 550 was made of metal. This, however, is not a limitation, and for example, the developer supplying roller may be made of a material other than metal.

The foregoing embodiment, however, is more preferable in terms that, by making the developer supplying roller 550 out of metal, it is possible to make the restriction blade 560 and the elastic body layer of the developing roller 510 dig into the grooves 550*a* of the developer supplying roller 550 more appropriately.

Further, in the foregoing embodiment, the restriction blade 560 and the elastic body layer of the developing roller 510 were both made of rubber. This, however, is not a limitation, and they may be made of any kind of material as long as it is elastic.

Further, in the foregoing embodiment, non-volatile liquid developer D that is non-volatile at room temperature was used as the developer. This, however, is not a limitation. For example, the developer may be volatile liquid developer which employs Isopar (trademark: Exxon Mobil Corporation) as a carrier, has low concentration (approximately 1 to 2 wt %) and low viscosity, and is volatile at room temperature.

Non-volatile liquid developer, which is non-volatile at room temperature, is made to have a high viscosity in order to make it non-volatile. When high-viscosity liquid developer is used in the above-described developing device, rivulets tend to be formed due to the high viscosity of the liquid developer. The foregoing embodiment is therefore more effective in terms that the above-mentioned effect, that is, the effect of being able to curb the formation of rivulets and prevent deterioration of image quality, is achieved more advantageously.

Other Embodiments

In the foregoing, a developing device etc. according to the present invention was described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to full-color laser beam printers that are not of the intermediate transferring type. Further, other than full-color laser printers, the present invention is also applicable to monochrome laser beam printers. Furthermore, other than printers, the present invention is also applicable to various other types of image forming apparatuses such as copying machines and facsimiles.

Further, the photoconductor is not limited to the so-called "photoconductive roller" structured by providing a photoconductive layer on the outer peripheral surface of a cylindrical base. The photoconductor can be, for example, a so-called "photoconductive belt" structured by providing a photoconductive layer on a surface of a belt-like base.

Further, in the foregoing embodiments, the restriction blade 560 was arranged such that its tip end faced toward the downstream side of the rotating direction of the developer supplying roller 550, and thus, carried out a so-called "trailing restriction". This, however, is not a limitation. For example, the restriction blade may be arranged such that its tip end faces toward the upstream side of the rotating direction of the developer supplying roller, thus carrying out a so-called "counter restriction".

Further, in the foregoing embodiments, the developing roller 510 served as the developer bearing body and the developer supplying roller 550 served as the developer supplying member. This, however, is not a limitation, and for example, a developing belt and/or a developer supplying belt having a belt-like shape may be adopted.

Configuration of Image Forming System etc.

Next, an embodiment of an image forming system, which serve as an example of an embodiment of the present invention, is described with reference to the drawings.

Figure 20:
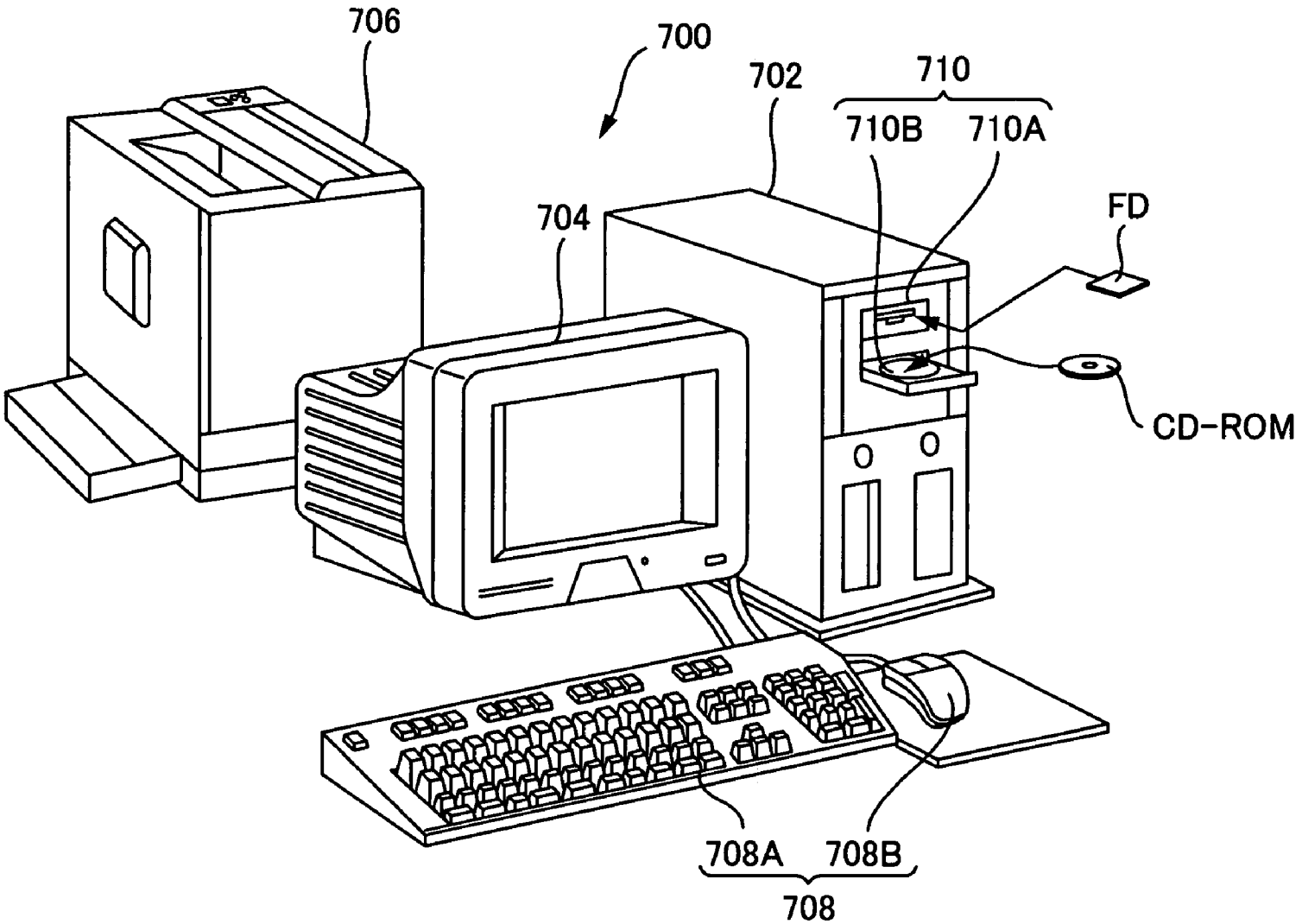
FIG. 20 is an explanatory drawing showing an external structure of an image forming system.

FIG. 20 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 21:
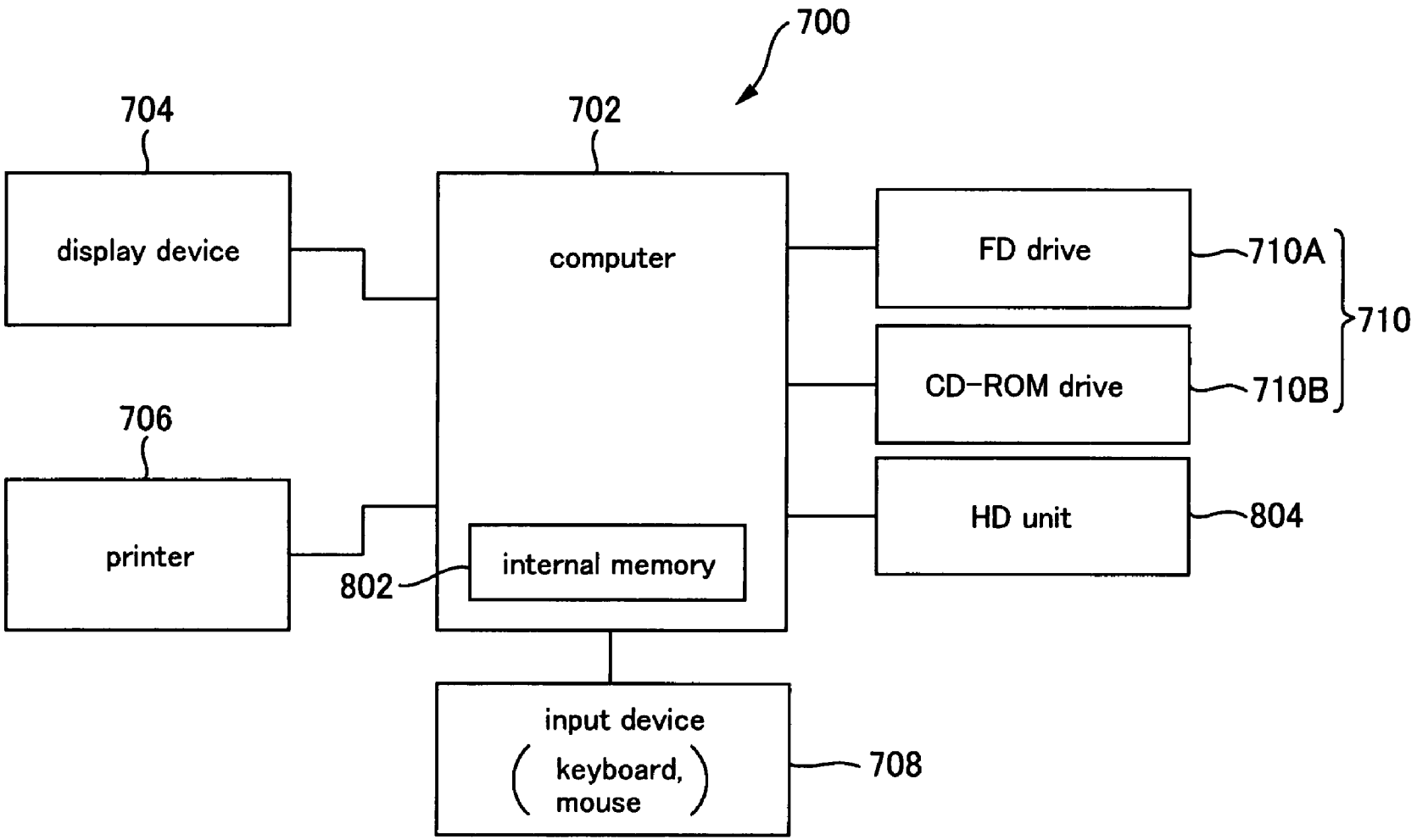
FIG. 21 is a block diagram showing a configuration of the image forming system shown in FIG. 20.

FIG. 21 is a block diagram showing a configuration of the image forming system shown in FIG. 20. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device comprising:

a developer hearing body for bearing liquid developer, said liquid developer bore by said developer hearing body being used by said developing device to develop a latent image bore by an image bearing body;

a developer supplying member that has depressions in its surface and whose surface is pressed in contact with said developer bearing body for supplying the liquid developer retained in said depressions to said developer bearing body; and a restricting section for restricting the amount of said liquid developer on said developer supplying member, wherein the amount of said liquid developer, which is retained in said depressions and whose amount has been restricted by said restricting section, before being supplied to said developer bearing body is smaller than the volumetric capacity of said depressions that retain said liquid developer, wherein said developer bearing body is a developing roller and said developer supplying member is a developer supplying roller, wherein said restricting section is a restriction blade that abuts against the surface of said developer supplying roller to restrict the amount of said liquid developer on said developer supplying roller, wherein said developing roller has an elastic section and said surface of said developer supplying roller is pressed in contact with said elastic section to supply said liquid developer to said developer roller, and wherein the hardness of an abutting section of said restriction blade where said restriction blade abuts against said surface of said developer supplying roller is smaller than the hardness of a press-contact section of said elastic section where said elastic section is pressed in contact with said surface of said developer supply roller.

2. A developing device according to claim 1, wherein the rotating direction of said developing roller is opposite from the rotating direction of said developer supplying roller.

3. A developing device according to claim 1, wherein said developer supplying roller is made of metal.

4. A developing device according to claim 1, wherein said restriction blade and said elastic section of said developing roller are both made of rubber.

5. A developing device according to claim 1, wherein said liquid developer is a non-volatile liquid developer that is non-volatile at room temperature.

6. A developing device comprising:

a developer bearing body for bearing liquid developer, said liquid developer bore by said developer bearing body being used by said developing device to develop a latent image bore by an image bearing body;

a developer supplying member that has depressions in its surface and whose surface is pressed in contact with said developer bearing body for supplying the liquid developer retained in said depressions to said developer bearing body; and a restricting section for restricting the amount of said liquid developer on said developer supplying member, wherein the amount of said liquid developer, which is retained in said depressions and whose amount has been restricted by said restricting section, before being supplied to said developer bearing body is smaller than the volumetric capacity of said depressions that retain said liquid developer, wherein:

said developer bearing body is a developing roller, and said developer supplying member is a developer supplying roller;

said restricting section is an elastic restriction blade;

said restriction blade abuts against the surface of said developer supplying roller to restrict the amount of said liquid developer on said developer supplying roller;

said developing roller has an elastic section;

said surface of said developer supplying roller is pressed in contact with said elastic section to supply said liquid developer to said developing roller;

the hardness of an abutting section of said restriction blade where said restriction blade abuts against said surface of said developer supplying roller is smaller than the hardness of a press-contact section of said elastic section where said elastic section is pressed in contact with said surface of said developer supplying roller;

the rotating direction of said developing roller is opposite from the rotating direction of said developer supplying roller;

said developer supplying roller is made of metal;

said restriction blade and said elastic section of said developing roller are both made of rubber; and said liquid developer is a non-volatile liquid developer that is non-volatile at room temperature.

7. An image forming apparatus comprising:

an image bearing body for bearing a latent image; and a developing device that has:

a developer bearing body for bearing liquid developer, said liquid developer bore by said developer bearing body being used by said developing device to develop the latent image bore by said image bearing body;

a developer supplying member that has depressions in its surface and whose surface is pressed in contact with said developer bearing body for supplying the liquid developer retained in said depressions to said developer bearing body; and a restricting section for restricting the amount of said liquid developer on said developer supplying member, wherein the amount of said liquid developer, which is retained in said depressions and whose amount has been restricted by said restricting section, before being supplied to said developer bearing body is smaller than the volumetric capacity of said depressions that retain said liquid developer, wherein said developer bearing body is a developing roller and said developer supplying member is a developer supplying roller.

wherein said restricting section is a restriction blade that abuts against the surface of said developer supplying roller to restrict the amount of said liquid developer on said developer supplying roller, wherein said developing roller has an elastic section and said surface of said developer supplying roller is pressed in contact with said elastic section to supply said liquid developer to said developing roller, and wherein the hardness of an abutting section of said restriction blade where said restriction blade abuts against said surface of said developer supply roller is smaller than the hardness of a press-contact section of said elastic section where said elastic section is pressed in contact with said surface of said developer supplying roller.

8. An image forming system comprising:

a computer; and an image forming apparatus that is connectable to said computer and that has:

an image bearing body for bearing a latent image; and a developing device that has:

a developer bearing body for bearing liquid developer, said liquid developer bore by said developer bearing body being used by said developing device to develop the latent image bore by said image bearing body;

a developer supplying member that has depressions in its surface and whose surface is pressed in contact with said developer bearing body for supplying the liquid developer retained in said depressions to said developer hearing body; and a restricting section for restricting the amount of said liquid developer on said developer supplying member, wherein the amount of said liquid developer, which is retained in said depressions and whose amount has been restricted by said restricting section, before being supplied to said developer bearing body is smaller than the volumetric capacity of said depressions that retain said liquid developer, wherein said developer bearing body is a developing roller and said developer supplying member is a developer supplying roller, wherein said restricting section is a restriction blade that abuts against the surface of said developer supplying roller to restrict the amount of said liquid developer on said developer supplying roller, wherein said developing roller has an elastic section and said surface of said developer supplying roller is pressed in contact with said elastic section to supply said liquid to said developing roller, and wherein the hardness of an abutting section of said restriction blade where said restriction blade abuts against said surface of said developer supplying roller is smaller than the hardness of a press-contact section of said elastic section where said elastic section is pressed in contact with said surface of said developer supplying roller.

9. A developing device comprising;

a developer bearing body that has an elastic section and that is for bearing liquid developer, said liquid developer bore by said developer bearing body being used by said developing device to develop a latent image bore by an image bearing body;

a developer supplying member that has depressions in its surface and whose surface is pressed in contact with said elastic section of said developer bearing body for supplying the liquid developer retained in said depressions to said developer bearing body; and a restriction member for restricting the amount of said liquid developer on said developer supplying member by abutting against the surface of said developer supplying member, said restriction member being an elastic body wherein said developer bearing body is a developing roller, and said developer supplying member is a developer supplying roller, wherein the hardness of an abutting section of said restriction member where said restriction member abuts against the surface of said developer supplying roller is smaller than the hardness of a press-contact section of said elastic section where said elastic section is pressed in contact with said surface of said developer supplying roller.

10. A developing device according to claim 9, wherein the rotating direction of said developing roller is opposite from the rotating direction of said developer supplying roller.

11. A developing device according to claim 9, wherein said restriction member abuts against said surface of said developer supplying roller at its edge to restrict the amount of said liquid developer on said developer supplying roller.

12. A developing device according to claim 9, wherein said developer supplying roller is made of metal.

13. A developing device according to claim 9, wherein said restriction member and said elastic section of said developing roller are both made of rubber.

14. A developing device according to claim 9, wherein said liquid developer is a non-volatile liquid developer that is non-volatile at room temperature.

15. A developing device comprising:

a developer hearing body that has an elastic section and that is for bearing liquid developer, said liquid developer bore by said developer bearing body being used by said developing device to develop a latent image bore by an image bearing body a developer supplying member that has depressions in its surface and whose surface is pressed in contact with said elastic section of said developer bearing body for supplying the liquid developer retained in said depressions to said developer bearing body; and a restriction member for restricting the amount of said liquid developer on said developer supplying member by abutting against the surface of said developer supplying member, said restriction member being an elastic body, wherein:

said developer bearing body is a developing roller, and said developer supplying member is a developer supplying roller;

the hardness of an abutting section of said restriction member where said restriction member abuts against the surface of said developer supplying roller is smaller than the hardness of a press-contact section of said elastic section where said elastic section is pressed in contact with said surface of said developer supplying roller;

the rotating direction of said developing roller is opposite from the rotating direction of said developer supplying roller;

said restriction member abuts against said surface of said developer supplying roller at its edge to restrict the amount of said liquid developer on said developer supplying roller;

said developer supplying roller is made of metal;

said restriction member and said elastic section of said developing roller are both made of rubber; and said liquid developer is a non-volatile liquid developer that is non-volatile at room temperature.

16. A restriction member comprising:

an elastic body, said restriction member being provided in a developing device that has:

a developer bearing body that has an elastic section and that is for bearing liquid developer, said liquid developer bore by said developer bearing body being used by said developing device to develop a latent image bore by an image bearing body; and a developer supplying member that has depressions in its surface and whose surface is pressed in contact with said elastic section of said developer bearing body for supplying the liquid developer retained in said depressions to said developer bearing body, wherein said restriction member restricts the amount of said liquid developer on said developer supplying member by abutting against the surface of said developer supplying members, wherein said developer bearing body is a developing roller, and said developer supplying member is a developer supplying roller, wherein the hardness of an abutting section of said restriction member where said restriction member abuts against the surface of said developer supplying roller is smaller than the hardness of a press-contact section of said elastic section where said elastic section is pressed in contact with said surface of said developer supplying roller.

17. An image forming apparatus comprising:

an image bearing body for bearing a latent image; and a developing device that has:

a developer bearing body that has an elastic section and that is for bearing liquid developer, said liquid developer bore by said developer bearing body being used by said developing device to develop the latent image bore by said image bearing body;

a developer supplying member that has depressions in its surface and whose surface is pressed in contact with said elastic section of said developer bearing body for supplying the liquid developer retained in said depressions to said developer bearing body; and a restriction member for restricting the amount of said liquid developer on said developer supplying member by abutting against the surface of said developer supplying member, said restriction member being an elastic body, wherein said developer bearing body is a developing roller, and said developer supplying member is a developer supplying roller, wherein the hardness of an abutting section of said restriction member where said restriction member abuts against the surface of said developer supplying roller is smaller than the hardness of a press-contact section of said elastic section where said elastic section is pressed in contact with said surface of said developer supplying roller.

18. An image forming system comprising:

a computer; and an image forming apparatus that is connectable to said computer and that has:

an image bearing body for bearing a latent image; and a developing device that has:

a developer bearing body that has an elastic section and that is for bearing liquid developer, said liquid developer bore by said developer bearing body being used by said developing device to develop the latent image bore by said image bearing body;

a developer supplying member that has depressions in its surface and whose surface is pressed in contact with said elastic section of said developer bearing body for supplying the liquid developer retained in said depressions to said developer bearing body; and a restriction member for restricting the amount of said liquid developer on said developer supplying member by abutting against the surface of said developer supplying member, said restriction member being an elastic body;

wherein said developer hearing body is a developing roller, and said developer supplying member is a developer supplying roller, wherein the hardness of an abutting section of said restriction member where said restriction member abuts against the surface of said developer supplying roller is smaller than the hardness of a press-contact section of said elastic section where said elastic section is pressed in contact with said surface of said developer supplying roller.

* * * * *